US005646512A

United States Patent [19]

Beckwith

[11] Patent Number: 5,646,512

[45] Date of Patent: Jul. 8, 1997

[54] MULTIFUNCTION ADAPTIVE CONTROLS FOR TAPSWITCHES AND CAPACITORS

[76] Inventor: Robert W. Beckwith, 2794 Camden Rd., Clearwater, Fla. 34619

[21] Appl. No.: 698,315

[22] Filed: Aug. 15, 1996

[51] Int. Cl.[6] ..... G05F 1/153; G05F 5/00

[52] U.S. Cl. ..... 323/257; 323/211

[58] Field of Search ..... 323/205, 207–211, 323/256, 257

[56] References Cited

U.S. PATENT DOCUMENTS 4,672,298 6/1987 Rohatyn ..... 323/208
4,829,229 5/1989 Johansson et al. ..... 323/209
5,315,527 5/1994 Beckwith ..... 364/483
5,402,057 3/1995 D'Aquila et al. ..... 323/211
5,530,338 6/1996 Beckwith ..... 323/255
5,541,498 7/1996 Beckwith ..... 323/211
5,544,064 8/1996 Beckwith ..... 364/483
5,581,173 12/1996 Yalla et al. ..... 323/257

*Primary Examiner*—Matthew V. Nguyen
*Attorney, Agent, or Firm*—Leo J. Aubel

[57] ABSTRACT

A power system relay combining the functions of tapchanger control, capacitor control, substation data monitoring and communications.

44 Claims, 25 Drawing Sheets

MULTIFUNCTION ADAPTIVE CONTROLS FOR TAPSWITCHES AND CAPACITORS

BACKGROUND OF INVENTION:

Load tapchanging transformers are located in electric power transmission substations where higher voltages are reduced and regulated before supplying subtransmission systems. They are also found at other substations supplying regulated intermediate voltages to power distribution lines. Alternatively load tapchanging regulators are sometimes used with fixed ratio voltage reducing transformers in place of load tapchanging transformers at distribution stations where the combination supplies regulated voltages to each phase of outgoing power distribution lines. Load tapchanging regulators are also found at intermediate points on longer distribution lines for re-regulation of the voltages. Intermediate voltages are stepped down to lower voltages, serving users of electric power, by fixed ratio transformers located along the distribution lines.

Autotransformers with switched taps for voltage regulation, are commonly simply referred to as "regulators". The term "LTC transformer" is commonly used to distinguish two winding voltage changing transformers with switched taps for voltage regulation from fixed ratio voltage changing transformers. These conventions in terminology will be followed herein.

Controls for load tap changing transformers and regulators generally have features as called for in ANSI standards C57.15-1986 for regulators and C57.12.10 for LTC transformers. The standards refers to settable bandwidths of up to 6 volts total bandwidth, around an also settable center voltage. One of two types of out-of-band timers is generally supplied, each having a time out value Settable up to 120 seconds after which a raise or lower tap position command is made to motor driven tapswitches. A first type of timer times linearly when the voltage is above or below the band and resets immediately whenever the voltage returns to within the band. A second type, known as an integrating timer times up linearly whenever the voltage is outside the band and times down at the same rate whenever the voltage is within the band.

Tapswitch life is found to be dependent on the rate of switch operation and on the square of current levels each time the switch operates. It is therefore, a concern for users of present art load tapchanger controls (LTC's) to attempt to set the time out value and the bandwidth values so as to obtain satisfactory voltage regulation yet not cause more than a desired number of tapchanges in a given time. This is often found in practice to be a long, laborious and generally unsatisfactory procedure. Present art generally does not take the level of the current into account, except to block the tapchanger entirely above some selected current level.

Switched power factor correction capacitors are also used across the secondaries of substation LTC transformers. Switching of these capacitors is generally accomplished using controls separated from LTC transformer controls. This reportedly often results in undesired interactions between capacitor switching and the LTC tapswitching operation.

Adaptive Capacitor Controls (ACC's) are now available using the inventions disclosed in the patents and patent applications listed below which require no setpoints and no human control. ACC's are used to switch poletop and padmounted power factor correction capacitor banks located along power distribution lines. These ACC controls adapt to factors such as a) to the line impedance at point of connection to the distribution line, and b) to the variation in electric customer loads nearby the point of capacitor connection to the distribution line. The result of ACC application to distribution lines fed by distribution power transformers is improved voltage regulation along the distribution lines and reduced VAr flow through the distribution substation transformers.

The industry has recently focussed on a problem commonly referred to as "voltage collapse" in which the voltage decreases slowly, as compared to a fault where voltages are affected suddenly. The term 'slowly' indicates a voltage decay period measured in minutes and seconds. This sometimes follows a fault whereafter remaining energized circuitry is unable to carry the load. At other times voltage collapse appears to be caused by a gradual buildup of load in excess of available generation and power delivery circuitry. It is generally found that present art supervisory control and data acquisition (SCADA) systems provide insufficient information to give any more than a superficial explanation of the voltage collapse phenomena. The ACC's help alleviate this problem by switching capacitors ON within one second as voltages collapse to a limit voltage generally set 5% below nominal voltage.

Downsizing of electric utilities has resulted in work burdens on fewer personnel which, in turn, calls for more automated equipment. At the same time competition between utilities resulting from the Energy Policy Act of 1992 has led to requirements to carry more power through distribution transformers and lines. Again a greater use of automation is indicated.

U.S. Pat. No. 5,422,561 issued to Williams et al describes a radio control scheme of distribution line capacitor control in trial use in Southern California. This scheme reads voltages at lower voltage locations and telemeters these readings, generally by radio, to a central location. At the central location a mathematical model of the distribution system is used to compute whether or not each capacitor can be connected or disconnected without having the voltages after switching go outside limits established by state statutes. This scheme has the very labor intensive requirement of establishing the mathematical model required for its operation. Even more difficult is the continuing updating of this model that is required by the continual restructuring of distribution lines as customer loads shift. The system has been reported in the press as having difficulty with false operation of capacitor switches as truckers pass the capacitor locations with their licensed radios in use.

CROSS REFERENCES TO RELATED APPLICATIONS

Provisional application Ser. No. 60/002,988 filed on Aug. 30, 1995 by Robert W. Beckwith, the inventor herein, entitled "AN ADAPTIVE CONTROL FOR LOAD TAPCHANGING TRANSFORMERS AND REGULATORS" introduced the inventive concepts presented herein. These inventive concepts are explained herein in greater detail and are expanded to include inventive ways of performing other functions capable of being provided by a single microprocessor wherein the functions are combined using a single program.

U.S. Pat. No. 5,315,527, METHOD AND APPARATUS PROVIDING HALF-CYCLE DIGITIZATION OF AC SIGNALS BY AN ANALOG-TO-DIGITAL CONVERTER, issued to Robert W. Beckwith, the inventor herein, describes apparatus and methods for sensing only positive half cycles of alternating current (AC) signals.

U.S. Pat. No. 5,544,064, APPARATUS AND METHOD FOR SAMPLING SIGNALS SYNCHRONOUS WITH ANALOG-TO-DIGITAL CONVERTER, by Robert W. Beckwith, the inventer herein, describes apparatus and methods useful in adaptive tapchanger controls (ATC,s) 62 for obtaining samples of an AC wave synchronous with a free running analog to digital converter (ADC).

The present invention combines use of the half wave technology of U.S. Pat. No. 5,315,527 together with the synchronous linear technology of U.S. Pat. No. 5,544,064 in greatly reducing the hardware and software requirements and at the same time greatly increasing the operating speed of an adaptive multifunction control for use in an electric utility substation.

U.S. Pat. No. 5,541,498, DISTRIBUTION CIRCUIT VAR MANAGEMENT USING ADAPTIVE CAPACITOR CONTROL, issued to Robert W. Beckwith the inventer herein, describes apparatus and methods of using LTC control apparatus having a VAr bias to beneficently influence the switching of adaptive capacitor controls (ACC's). This invention describes the ACC's and system control of VArs using a variable voltage substation source which influences the switching of ACC's without the use of communications. The present invention fulfills the control of substation voltage as disclosed in U.S. Pat. No. 5,541,498 and adds the function of control of substation controls so as to provide overall VAr control of an electric utility system by coordinated capacitor switching.

U.S. Pat. No. 5,530,338, LOAD TAPCHANGER PARALLELING BY DAISY CHAIN COMPARISON OF LOAD CURRENTS, issued to Robert W. Beckwith the inventer herein, describes a method of paralleling load tapchanging transformers by comparing the relative phase angles of pairs of adjacent transformer load currents connected in daisy chain fashion around a ring. This patent requires accurate comparison of the relative phase of two AC currents; a requirement met in a simple and very accurate way by the present invention. Incorporation of the daisy chain paralleling becomes an easily added function provided by modest additions to the microprocessor program.

U.S. patent application Ser. No. 493,423, A METHOD FOR OBTAINING THE FUNDAMENTAL AND ODD HARMONIC COMPONENTS OF AC SIGNALS, filed by Robert W. Beckwith, the inventer herein, on Jun. 19, 1995 describes methods for obtaining the fundamental component and odd harmonics of a half wave AC signal. The principles for measurement of the fundamental component of AC currents and voltages are used in the present invention.

U.S. Pat. No. 5,581,173, MICROCONTROLLER-BASED TAPCHANGER EMPLOYING HALF-WAVE DIGITIZATION OF AC SIGNALS, filed by Murty Yalla, et al on Nov. 9, 1993 describes apparatus for keeping track of tap positions in tapchanging transformers and regulators which requires sensing of AC voltage states. In certain usage the apparatus and methods described in Ser. No. 152,001 cannot sense tapchanges by SCADA communications not involving the apparatus and not causing changes of AC voltage states. The present invention includes different apparatus which circumvents these problems and provides reliable keep track of tap positions of tapchanging transformers.

U.S. Pat. Nos. 5,315,527, 5,544,064, 5,541,498 and 5,530,338 as well as applications Ser. Nos. 002,988, 493,423 and 152,001 are incorporated herein by reference.

SUMMARY OF THE INVENTION

A multifunction control relay providing apparatus and methods for implementing automatically adaptive switching of load tapchanging transformers and regulators, thereby decreasing the number of tapchanges, measuring and using VArs to bias the regulated voltage to cause adaptive capacitors controls to switch distribution line capacitors, controlling the switching of substation capacitors, recording and communicating data externally.

The foregoing features and advantages of the present invention will be apparent from the following more particular description. The accompanying drawings, listed hereinbelow, are useful in explaining the invention.

BRIEF DESCRIPTIONS OF THE DRAWINGS

FIG. 1 is a drawing showing an ACC connected to an electrical power distribution circuit, together with an LTC transformer using the inventive control in a substation supplying voltage to ACC's;

FIG. 2 expands the substation portion of FIG. 1 to include the controlled switching of substation capacitor banks;

Figure 17:
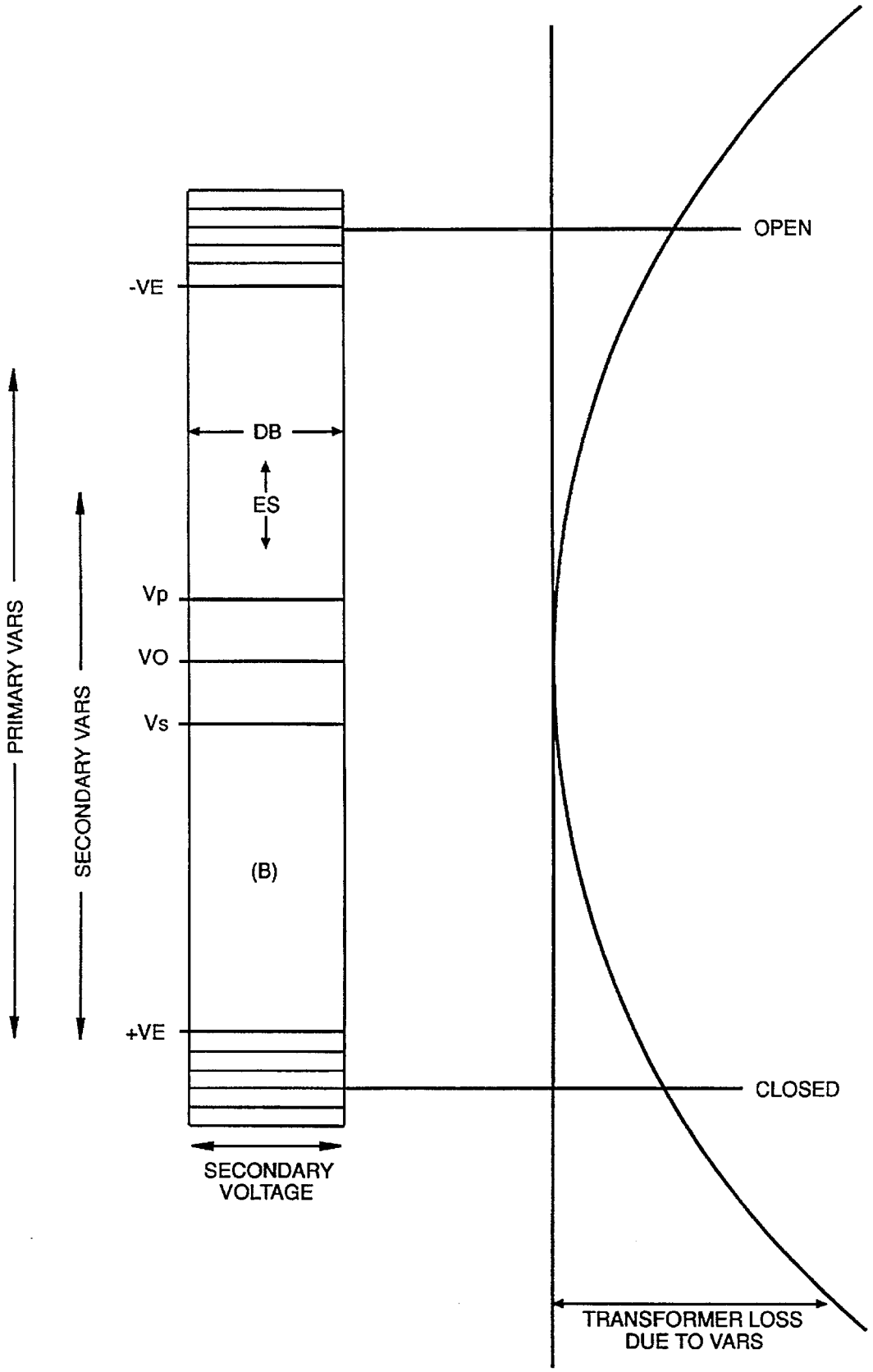
Figure 18:
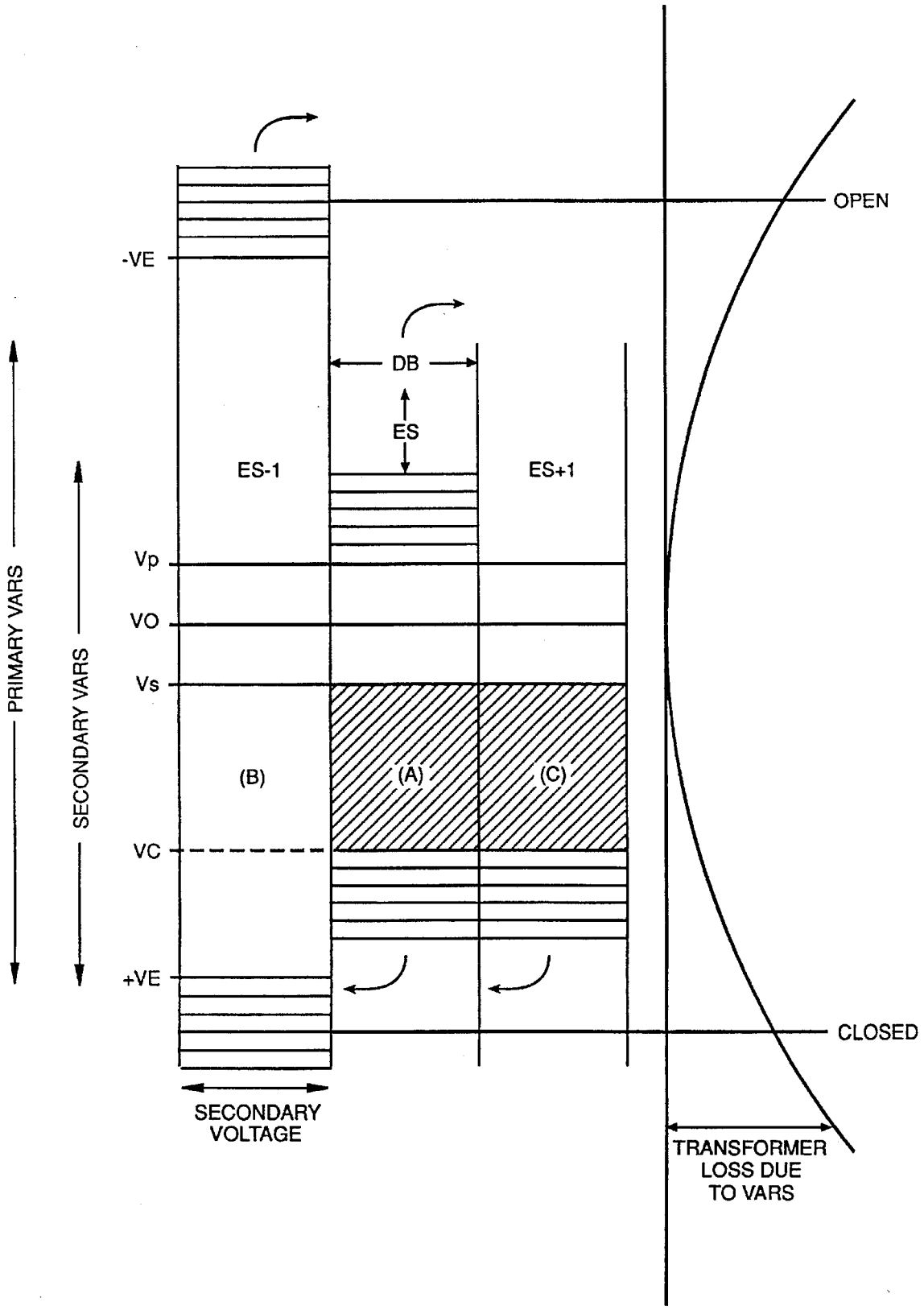
Figure 19:
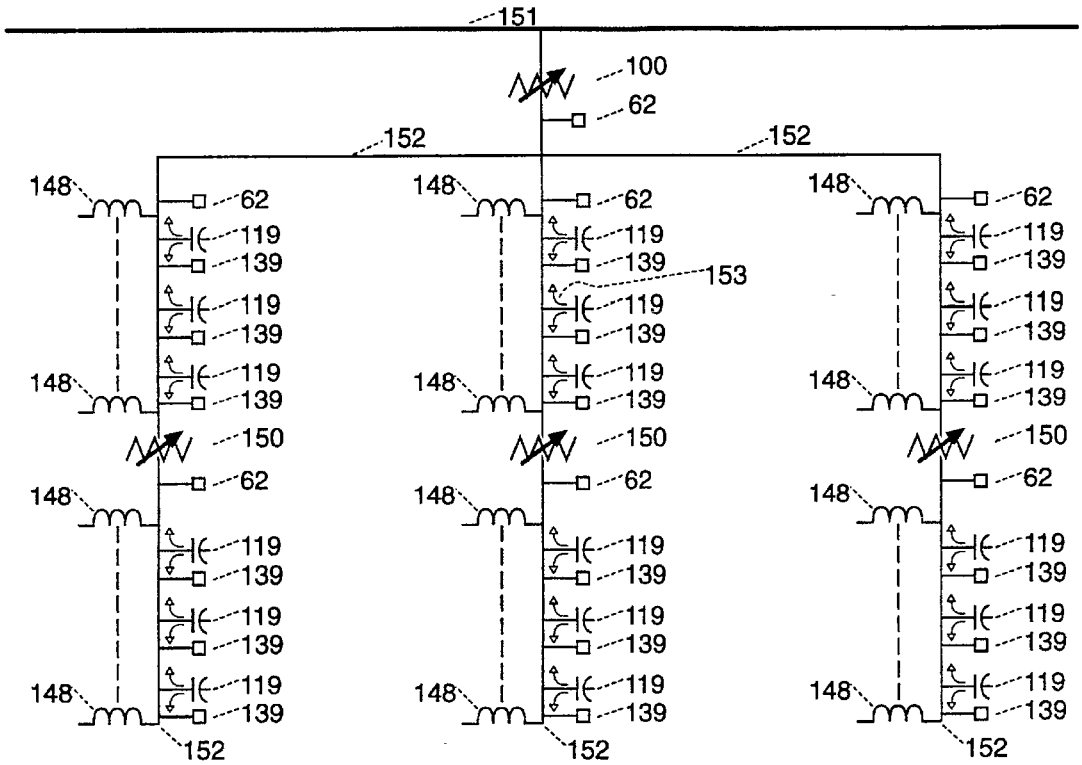
Figure 20:
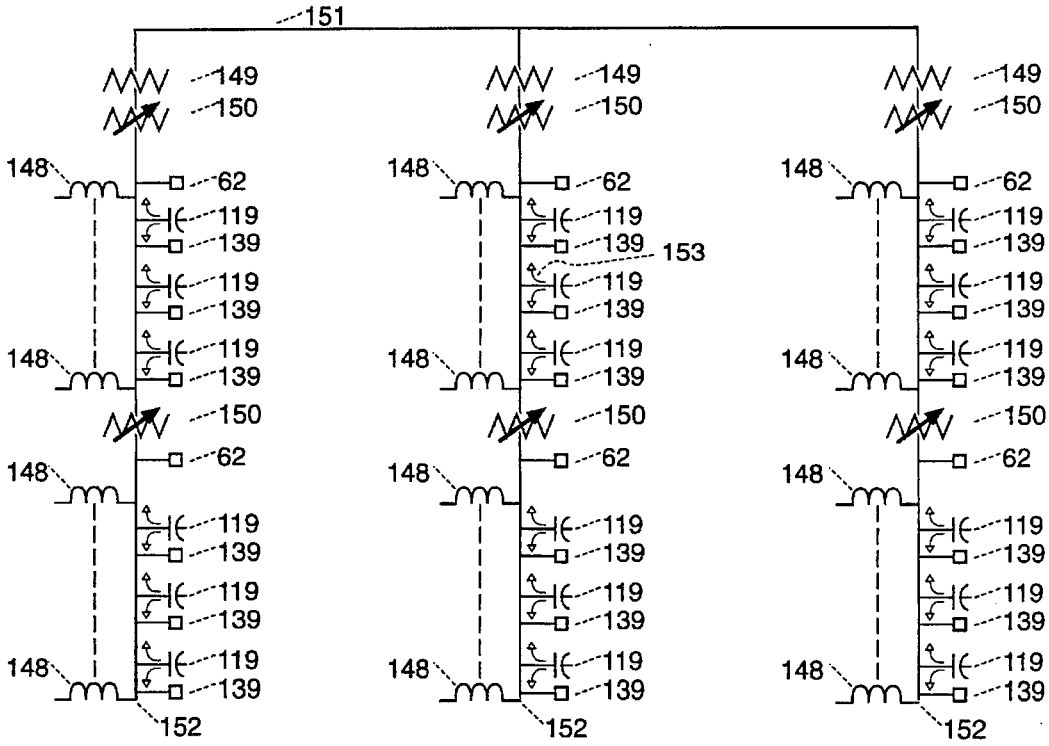
Figure 21:
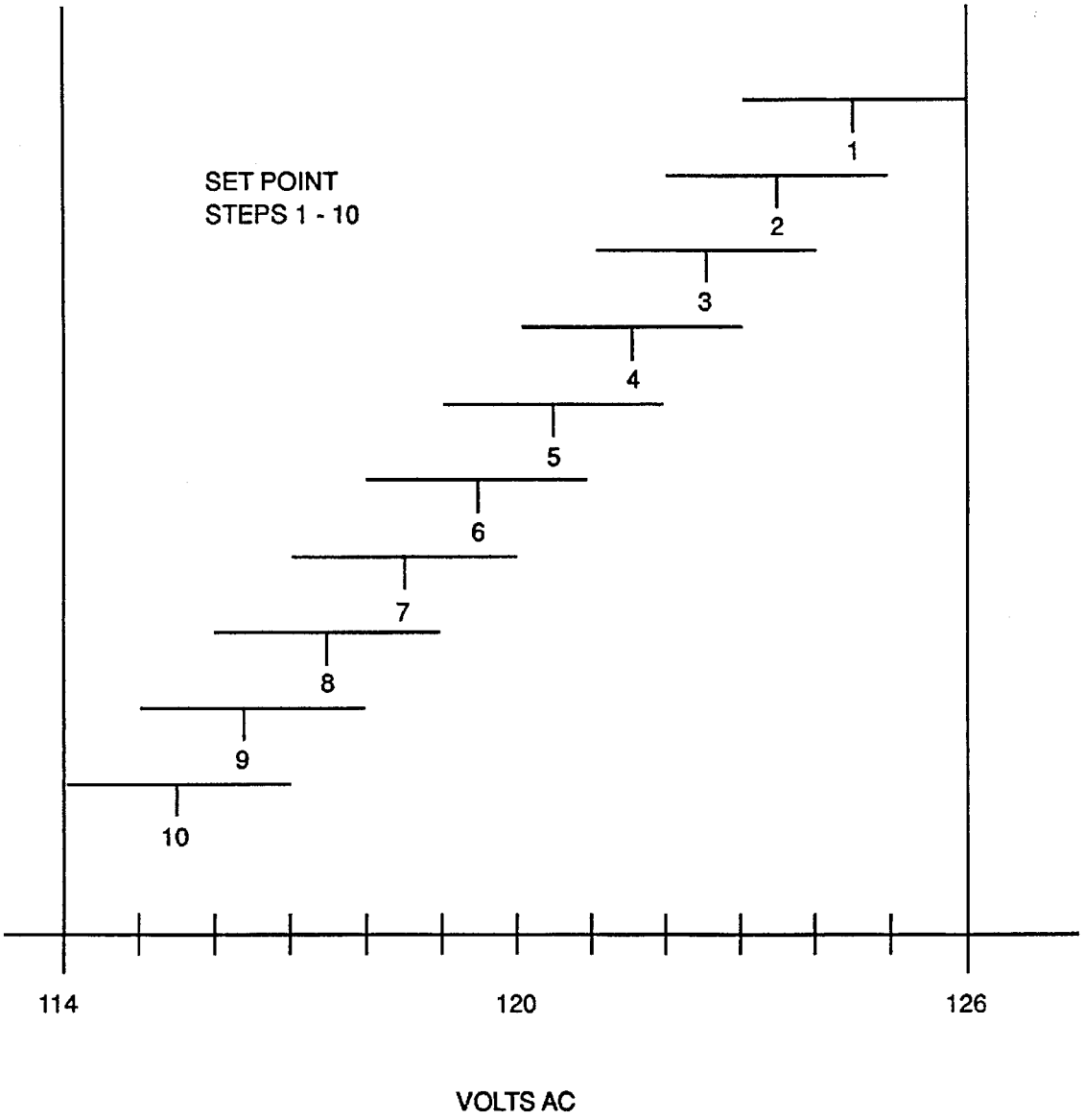
Figure 22:
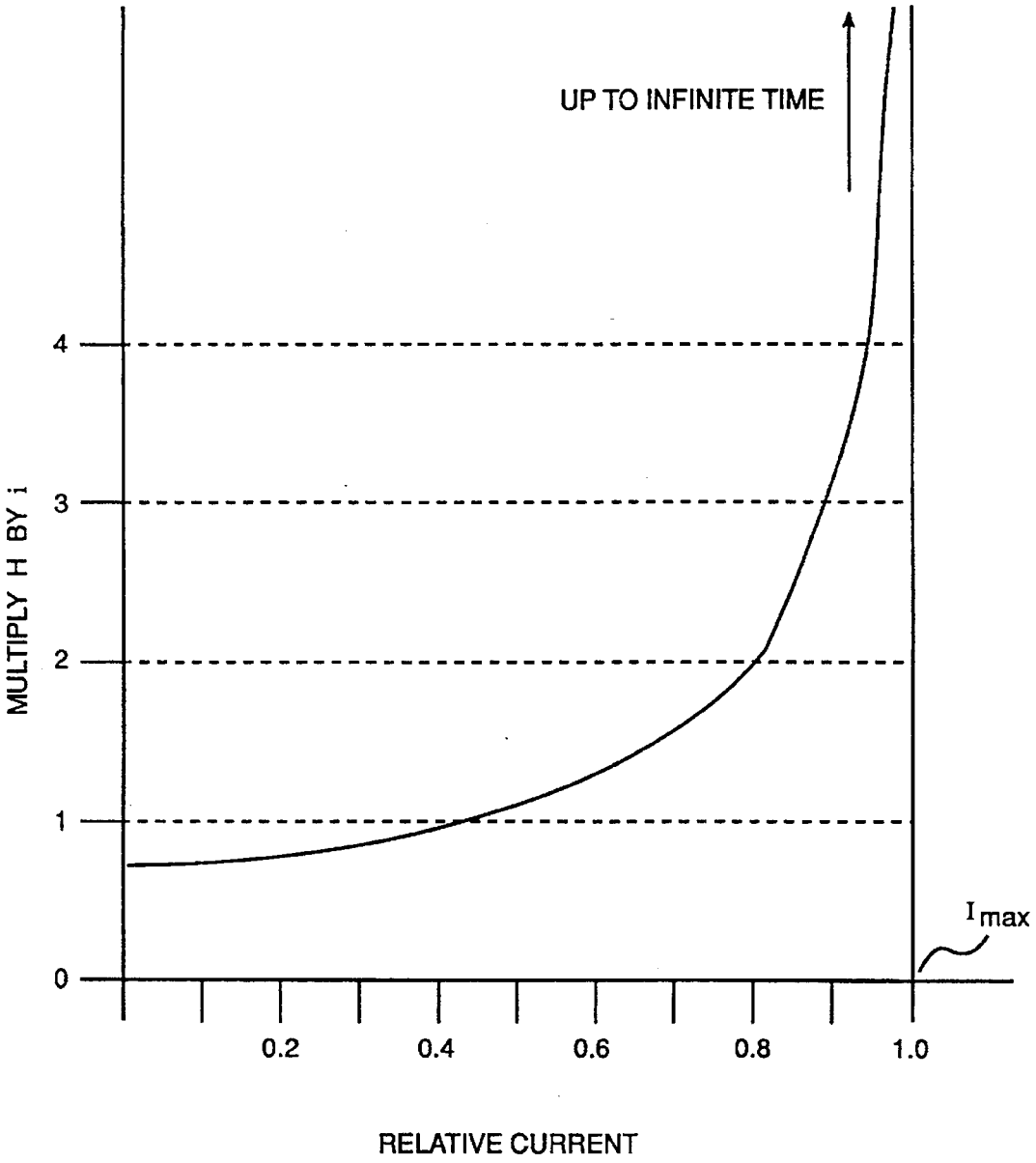
Figure 23:
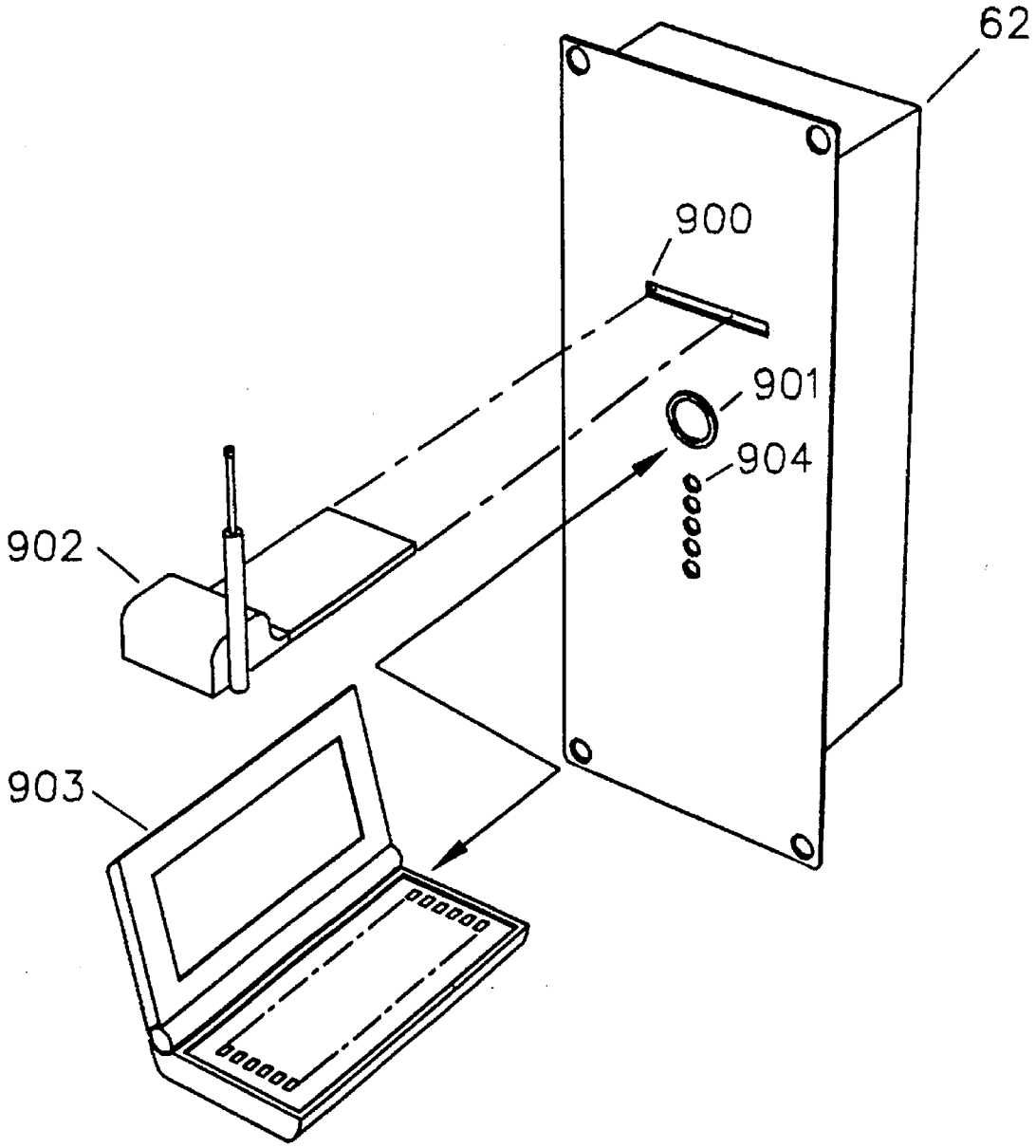
Figure 24:
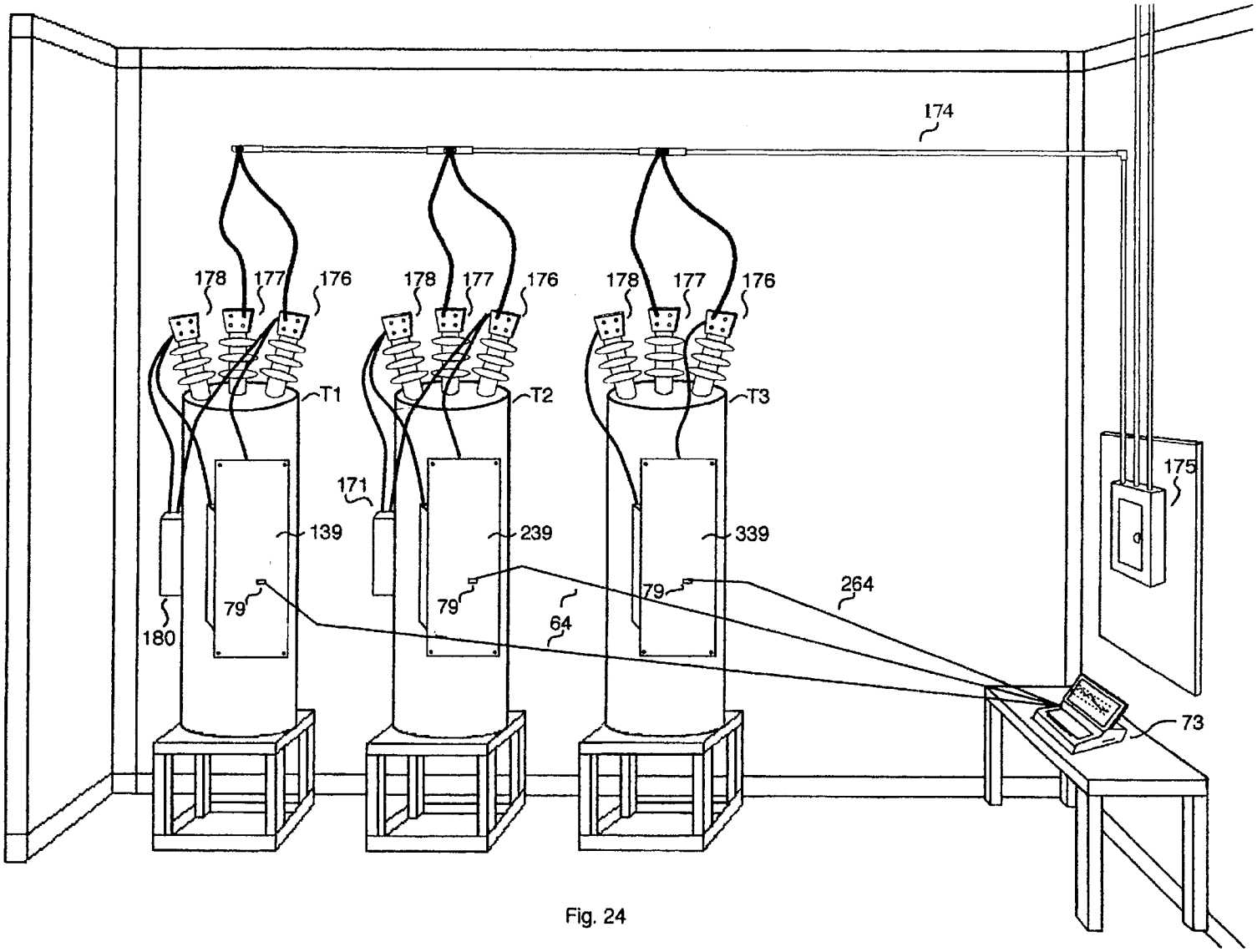
Figure 25:
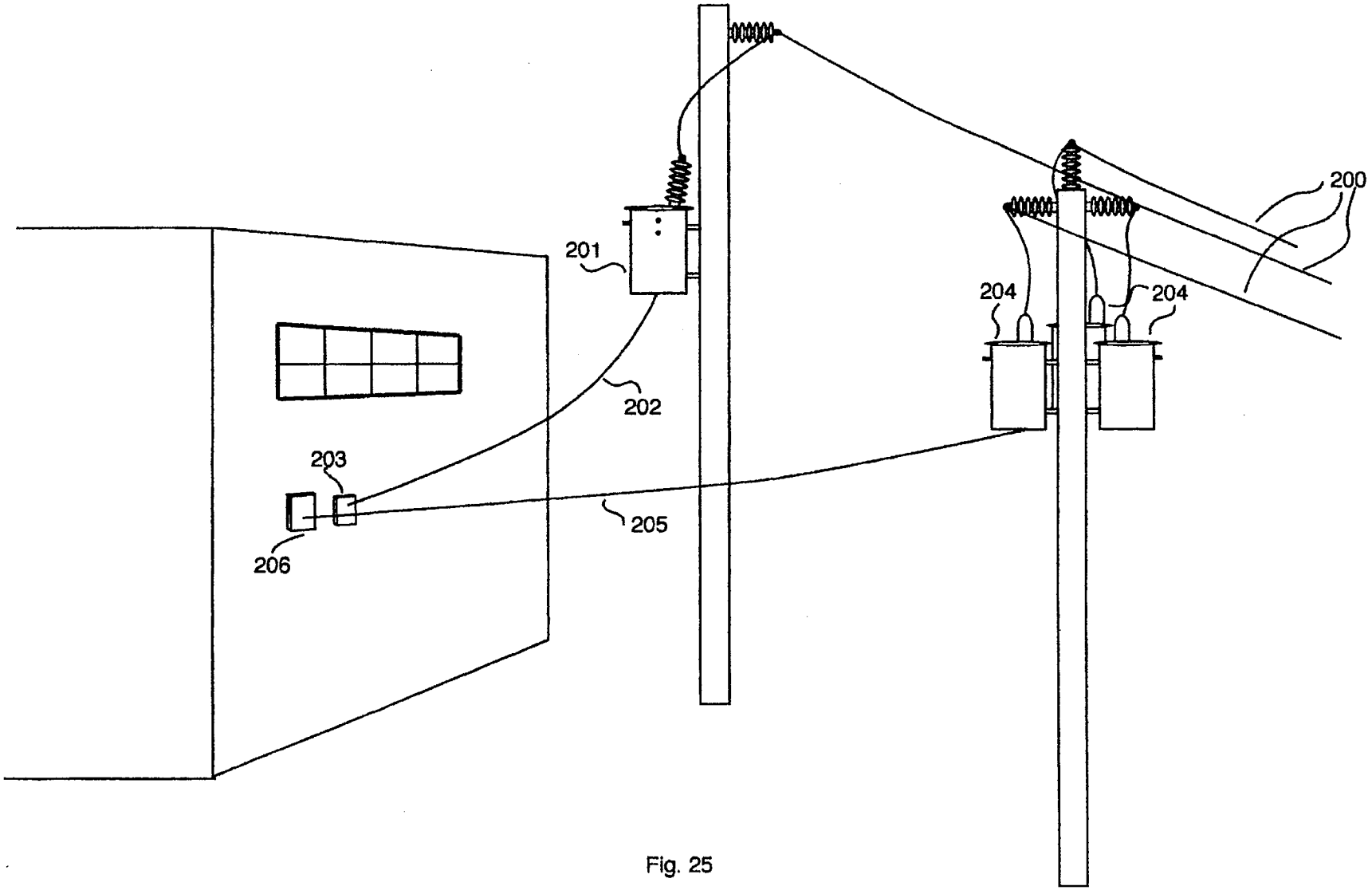
Figure 27:
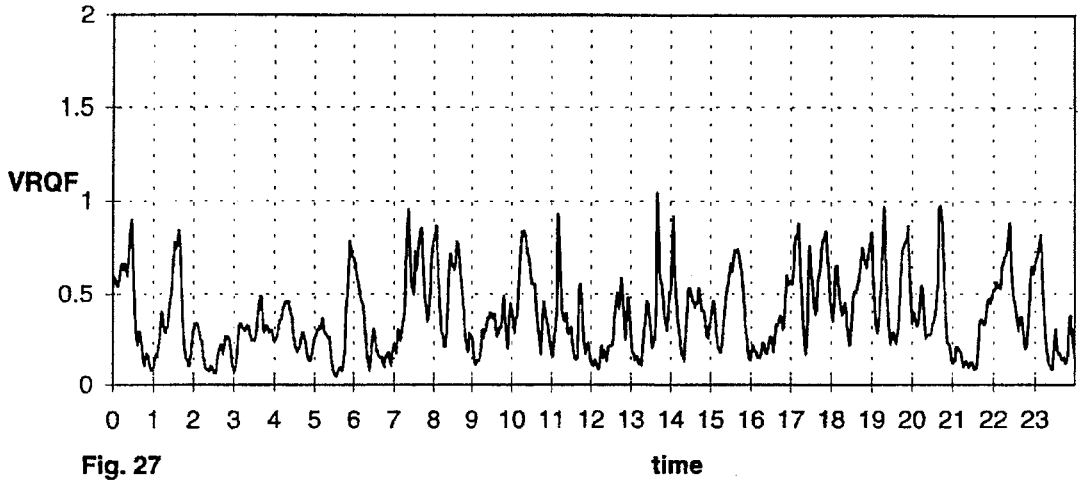
Figure 26:
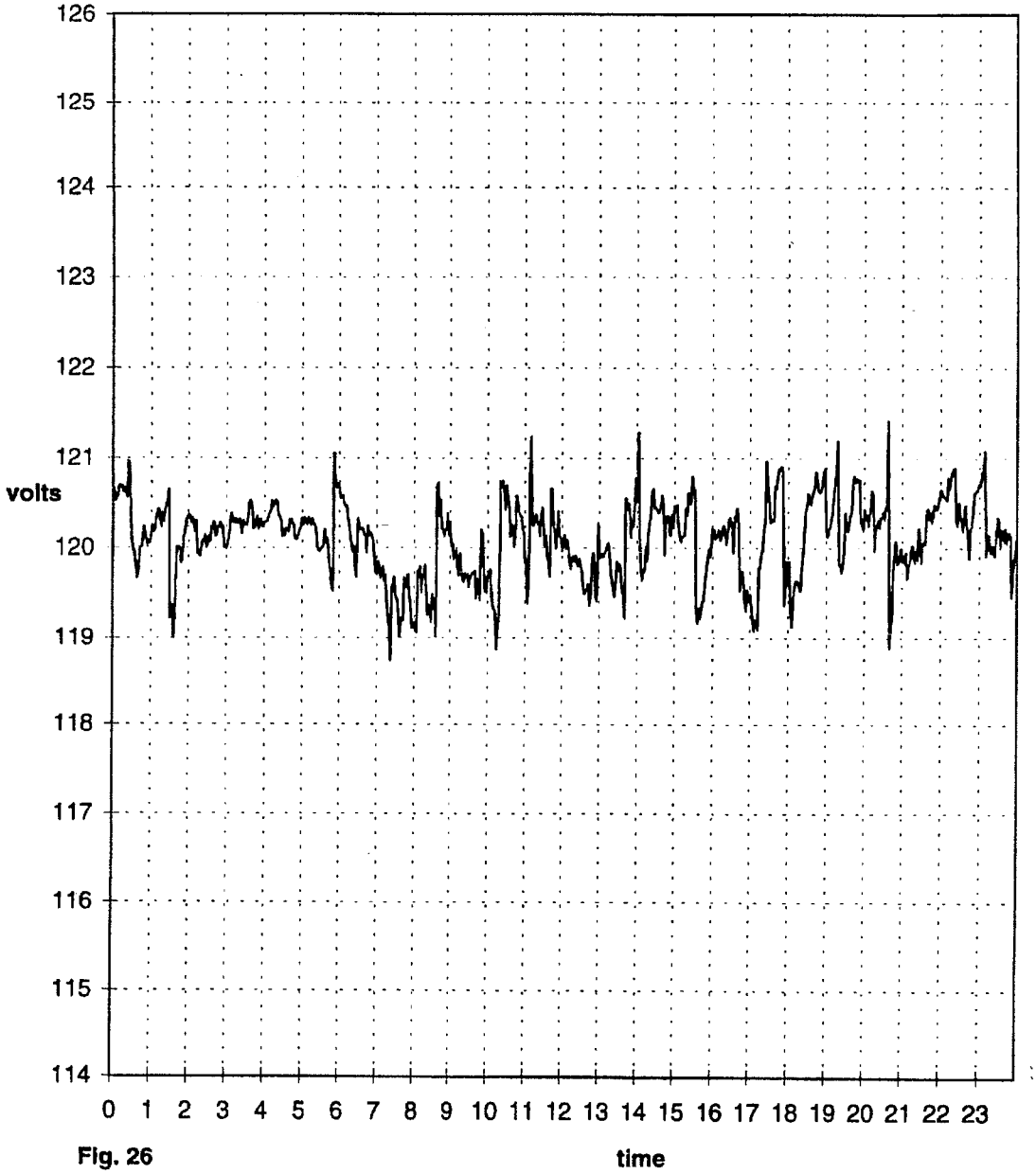

FIG. 17 contains diagrams useful in describing the controlled switching of substation capacitor banks by the inventive control;

FIG. 18 is a diagram useful in explaining the combined influence on ACC's together with switching substation capacitors using the inventive control;

FIG. 19 is a one line diagram of a transmission line feeding a load tapchanging transformer in turn feeding three distribution lines having line regulators, customer loads and ACC's showing restricted flow VAr flow paths;

FIG. 20 is a three line diagram of a transmission line feeding a step-down transformer and load tapchanging regulator in each phase of one distribution line having line regulators, customer loads and ACC's illustrating further restricted VAr flow paths;

FIG. 21 shows automatic voltage reduction for load management;

FIG. 22 shows lengthening of the "H" timeout as a function of transformer load current;

FIG. 23 is an isometric view of the inventive control having a two way infra-red port and using an external computer as the man-machine interface and also the addition of a wireless modem;

FIG. 24 shows a test setup involving three single phase regulators;

FIG. 25 shows an isolated 120/240 VAC service drop to the experimental setup of FIG. 24;

FIG. 26 is a 24 hour plot of the output voltage of a regulator using the inventive tapchanging control techniques;

FIG. 27 is a 24 hour plot of the two minute average values of VRQF of a regulator using the inventive tapchanging control techniques.

DESCRIPTION OF THE PREFERRED EMBODIMENTS

A DAY OF WATTS AND VAR CONTROL

In order to better understand the interrelations of the various aspects of the present invention it is helpful to review the expected operation during a typical day of a single adaptive tapchanger control (ATC) controlling a load tapchanging transformer at a distribution substation feeding lines having a number of capacitors switched by ACC's spaced along the lines.

Starting at midnight, it is expected that the ATC will have raised the voltage approximately one volt above the initial setpoint value and has influenced all but one ACC to switch its capacitor off. The one remaining CLOSED ACC corrects for the inductive load of customer supply transformers exciting currents and is located at the point which results in the least increase in voltage as compared to other capacitor locations. The resulting VAr flow through the LTC transformer is no greater than the VArs supplied by a single capacitor.

Typically both Watts and VArs load builds up rapidly at about 7:00 am, this being a hot, dry day later producing a seasonal peak load condition. The ATC sees the VAr requirements ascending and being compensated by the ACC closing of capacitor switches. The Ars increase faster than the capacitors switch, however and the VArs measured by the ATC increases beyond the size of a single capacitor. In response, the ATC decreases the voltage approximately one volt to the initial setpoint value. This decrease in voltage speeds the ACC response and CLOSES more capacitors thereby keeping the VAr flow through the LTC transformer generally less than that supplied by a single capacitor.

At about 11:00 am, the VArs exceed the amount supplied by a single capacitor and the ATC lowers the voltage approximately one volt below the initial setpoint value. This influences all ACC's to CLOSE the related capacitors thereby giving all available VAr support to the lines fed by the LTC transformer.

During this peak load day, however, this is insufficient to maintain the VAr flow through the LTC transformer within the range of VArs supplied by a single capacitor. The ATC maintains a record of the Watts and VArs measured and thereby records the peak Watts delivered by the LTC transformer and the peak VArs flowing through the transformer. The ATC also maintains a record of the voltage and voltage regulation quality.

As the load builds up, the ATC reads the transformer temperature and further lowers the voltage in approximately one volt steps, thereby temporarily decreasing the Watts load. This is sufficient to limit the transformer temperature.

At about 4:00 pm a thunderstorm occurs at about the same time people leave factories supplied by the lines. The reduced air conditioning load together with the reduced industrial load produces a rapid decrease in the inductive VArs in need of correction. The reduced load results in voltage increases which cause some ACC's to switch capacitors off. Even so, the VArs through the transformer rapidly go from lagging to leading. In further support of the sudden change, the ATC measures this shift and quickly responds by increasing the voltage to approximately the initial setpoint value. This influences further ACC's to switch the capacitors OFF where the voltage is already higher that at other locations.

Because of the rapid change in the weather, however, this is still fast enough and the ATC still sees leading VArs flowing through the transformer. The ATC responds by increasing the voltage approximately one volt above the initial setpoint value. This now influences enough of the capacitors to switch off to bring the VArs flowing through the transformer within the limits set by the size of a single capacitor.

The substation voltage is maintained at the one volt above setpoint value further influencing capacitors to switch OFF at locations with the highest voltage during the evening until only one is left CLOSED as people go to bed leaving the supply transformer exciting currents to again become a factor as midnight approaches.

Knowing that this was a peak day with a sudden change in the weather at a time known to be critical, the next day a system operator transfers data from this and other ATC's into Internet for study. The operator quickly finds the peak Watts and VArs. The Watts, added to other readings gives the peak generator load. In addition the readings shows the spread of the loadover the system.

From the peak VArs the operator determines the shortage of capacitor correction and gives this information to the planning department for consideration of adding more switched poletop capacitors.

The data obtained by Internet also includes the daily voltage profile from which the operator notes the minimum value and the rapid recovery to the initial setpoint value during the critical changes at 4:00 pm. The quality of voltage regulation is noted as well as the degradation in quality as required to overcome the changing conditions during the day. The daily profile of Watts shows that the automatic voltage reduction helped avoid transformer overload and averted the need for a system wide voltage reduction.

Since the weather condition was state wide, operators throughout the state are able to obtain data from neighboring utility substations and study the intercompany flow of power during the day.

THE INVENTION

Figure 1:
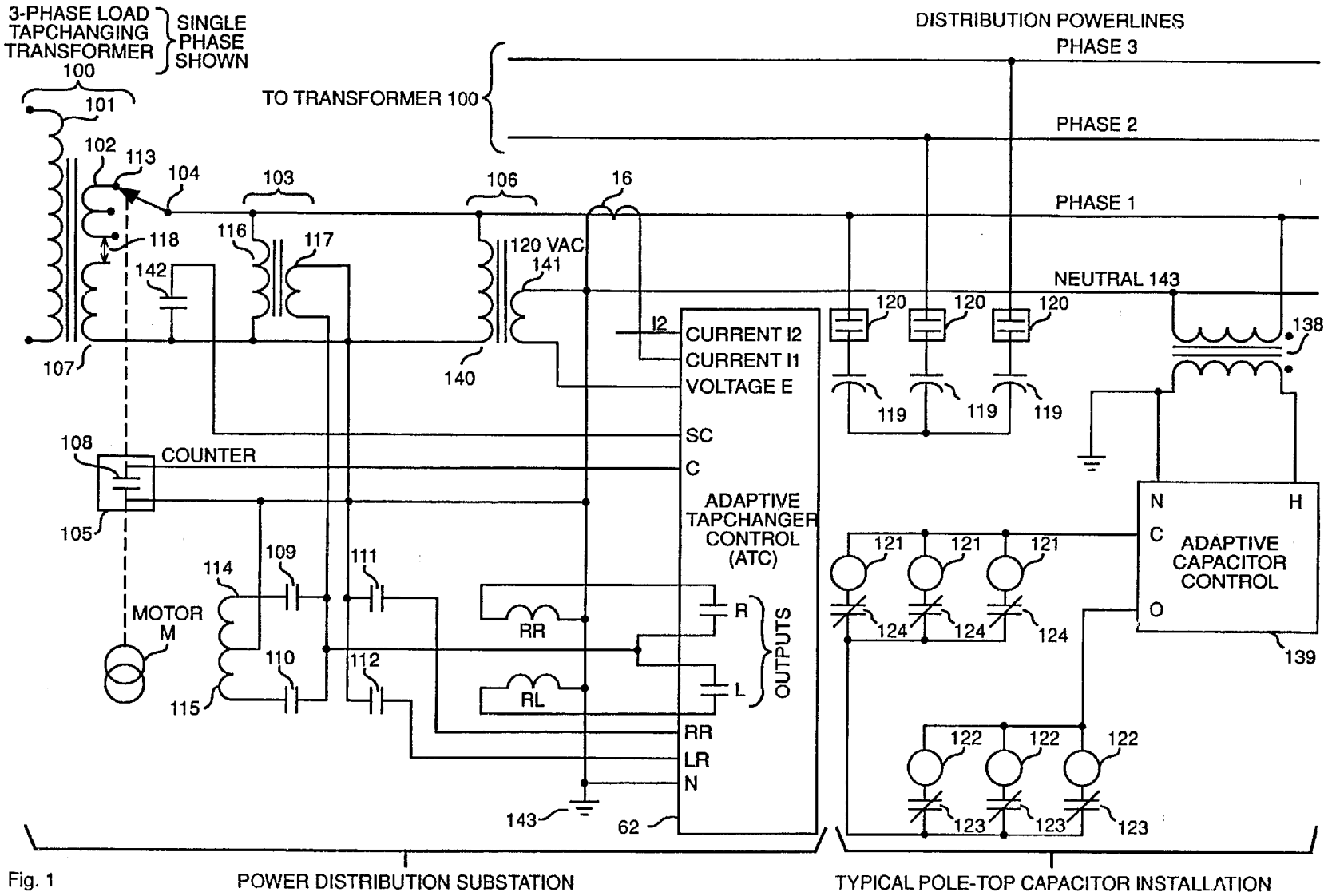
Figure 3:
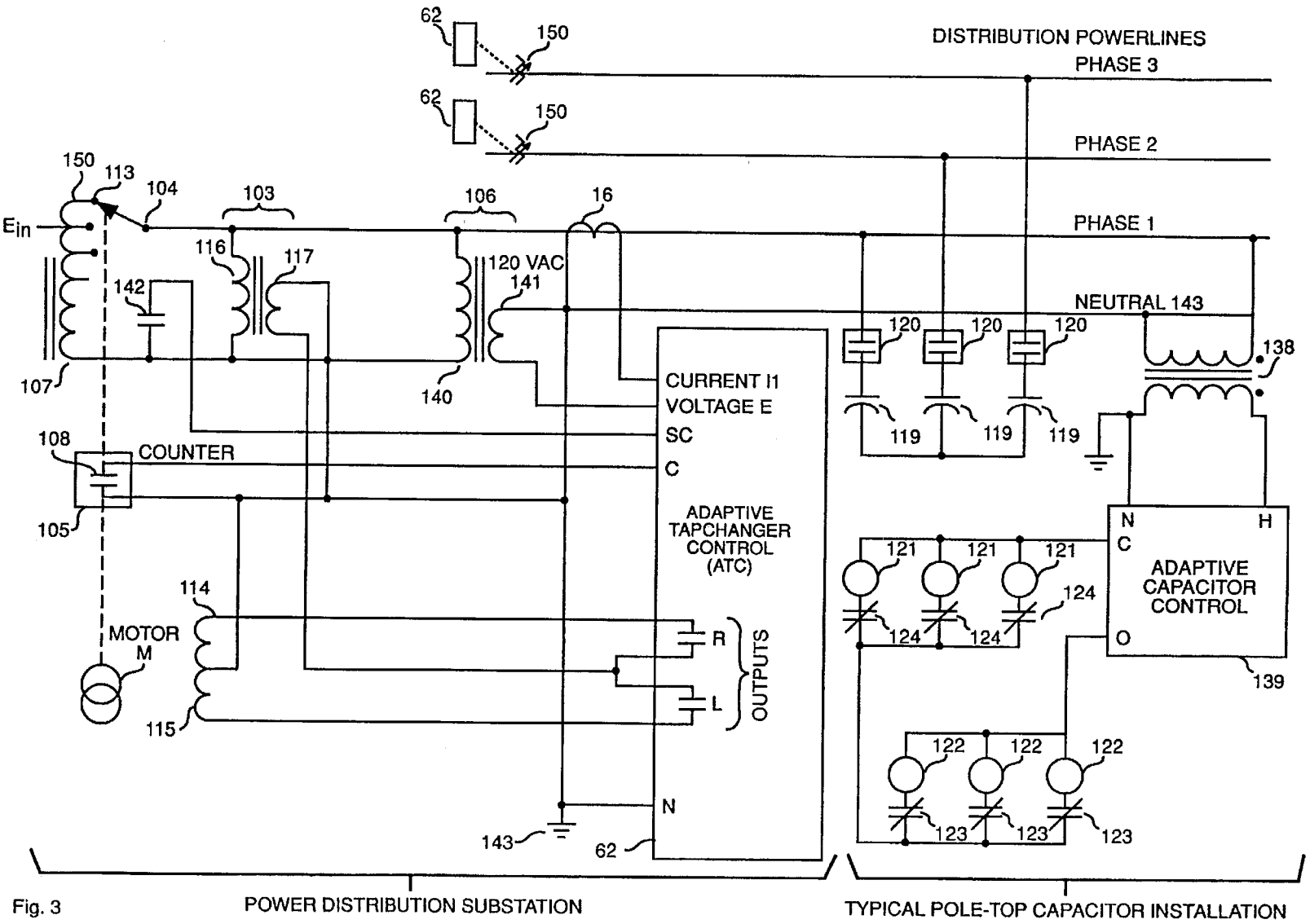
FIG. 3 is a drawing showing an ACC connected to an electrical power distribution circuit, together with a regulator using the inventive control in a substation supplying voltage to ACC's.

Please refer to FIGS. 1 and 3. This invention discloses inventive apparatus and methods useful in ATC's 62 for load tapchanging switches 104 on electric power LTC transformers 100 and regulators 150. Transformers 100 and regulators 150 are hereinafter referred to collectively as 'controlled devices'. Although certain differences exist in practice between controls for LTC transformers and regulators, ATC 62 will be considered herein as being useable with either LTC transformers or regulators for the purpose of illustrating the present invention.

The operation of an adaptive capacitor control 139 (ACC) controlling pole top capacitor banks 119 on distribution lines is shown in FIGS. 1 and 3. It has been found that the inventive adaptive methods of U.S. Pat. No. 5,541,498, cited above, can not be matched by manual operation of the controlled capacitor switches 120. This has led to use of inventive extensions of the adaptive methods in the present invention of ATC's 62 for use with controlled devices. The present invention reduces to a minimum the number of setpoints to be entered into the ATC's at time of installation. The present invention also eliminates the need for ongoing manual operation of tapswitches and in fact requires that such operation generally be blocked as being disruptive to optimum use of the tapswitches.

The voltage regulation quality factor, VRQF, by a controlled device is defined herein as the square root of the average of the sum of the squares of voltage deviations ▲E above and below a setpoint voltage ES. See equation 1) below.

1) $VRQF=((\Sigma(EM-ES)^2)/NM)^{1/2}$, where

2) $\blacktriangle E=EM-ES$ where ES is the voltage setpoint and EM is any voltage measurement.

The deviations ▲E are measured as often as once per AC cycle in ATC's 62 which sense voltage only. The deviations ▲E are typically measured 20 times per second in the ATC's 62 measuring both voltage and load current. The average of the squares is obtained using short term and long term recursive equations. The short term equation has a time constant in the order of minutes and is useful in displaying the variations in VRQF during a day, as shown in FIG. 27. These short term values of VRQF are then averaged using time constants preferably in the order of one week and used with counts of tapswitch operations to adaptively bring the number of tapswitch operations to a desired weekly average per day or alternatively to bring the quality of voltage control to a desired value.

A count of cycles of the input AC voltage signals is useful as measures of time by the microprocessor program. Descriptions of this method of timekeeping is given hereinunder.

FIG. 1 shows a power distribution substation circuit providing adaptive control of load tapchanging transformers 100 (shown for simplicity in single phase form). Transformers 100 have three phase primary windings 101, often at higher voltages of 69, 115 or 132 Kv, phase to phase. Transformer 100 secondaries consist of main windings 107 and tapped windings 102. Windings 102 are connected by switches 118 to buck or boost the voltages of the main windings 107.

Windings 102 have taps 113 on each of three phases selected by three phase tapswitches 104, in turn driven by motors M having drive mechanisms 105 with counter contacts 108; counter contacts 108 closing briefly when each tapchange is mechanically committed. The motors M drive mechanism also may include contacts 142 which are movable so as to be closed only on a tap position selected as one being often used and therefore suitable for frequent correction of a tapchange keep track procedure. Motors M are powered by single phase transformers 103 having primary 116 receiving voltages from phase 1 to neutral 143 of the voltage controlled outputs of transformers 100 via secondaries 117 generally at 120 or 240 Vac. Motors M may have windings 114 which, when powered, causes motors M to run in the direction of increasing tap position and having a winding 115 which, when powered, causes motors M to run in the direction of decreasing tap position. In any instance, motor direction is obtained by use of one or the other of two contact closures, R and L.

Transformers 106 provide 120 Vac from secondary windings 141 to the ATC's 62 in response to primary 140 connections between phase 1 and neutral 143. The ATC's 62 provide output raise (R) contacts and lower (L) contacts which correspondingly operate motor starter relays RR and RL. Contacts 109 on the motor starter relay RR cause the motors M to move in the raise direction when the relays RR are operated and contact 110 on the motor starter relays RL cause the motors M to move in the lower direction when the relays RL are operated. Isolated motor starter RR contact 111 closes upon operation of the starters RR connecting the ATC's 62 binary inputs RR to neutral 143 and isolated motor starter RL contacts 112 close upon operation of starters RL connecting ATC 62 binary inputs LR to neutral 143. The ATC's 62 sense closure of contacts 111, followed by closure of counter contacts 108 and increases the record of tap position by one. The ATC,s 62 further sense closure of contacts 112, followed by closure of counter contacts 108 and decrease the record of tap position by one. Adjustable switches 142 selectively are set to a frequently used tap position and are connected to the ATC's 62 binary terminals SC. The identities of the frequently used tap positions are entered into LTC controls 62; and, ATC's 62 correct the records of tap positions, if necessary, each time the tapswitches are on the frequently used tap positions.

Tapswitch knowledge is used hereinbelow to determine VP, the VArs flowing in or out of an LTC transformer primary. See discussions referring to FIG. 16.

FIG. 1 further shows typical pole-top capacitor installations together with phases 1, 2 and 3 and neutral 143 conductors of power distribution lines fed from the power distribution substations. Phases 1 and neutral 143 conductors are shown connected appropriately to the substation circuitry. Phases 2 and 3 are not shown connected to transformers 100; for simplicity transformer 100 is represented in single phase form. ACC's 139 receive power from phase 1 through stepdown transformers 138. Note that at other capacitor locations, transformers 138 may alternatively be connected to phases 2 or 3. Note that ACC 139 has terminals designated N, H, O and C representing Neutral, Hot, Open and Close. Hereinafter the expanded expressions for these terminals; Neutral, Hot, Open and Close will be used. The state of the capacitor switches 120 will be referred to as OPEN or OPENED and CLOSE or CLOSED. Power factor correction capacitors 119 are shown connectable through switches 120 to distribution circuits phases 1, 2 and 3. The ACC's 139 selectively close circuits from the ACC 139 terminals Hot to Close to operate magnetic devices 121, thereby closing switches 120 and connecting the capacitors 119 to the distribution powerlines and closes circuits from the ACC 139 terminals Hot to Open to operate magnetic devices 122, thereby opening switches 120 and disconnecting the capacitors 119 from the distribution powerlines.

After the devices 121 have performed their closing functions, they latch closed and contacts 124 open, removing power from the devices 121. After the devices 122 have performed their opening functions, they latch open and contacts 123 open, removing power from the devices 122.

U.S. Pat. No. 5,541,498 describes methods wherein the apparatus shown in FIG. 1 is used to control VArs flowing through transformer 100. The present invention provides additional adaptive features for ATC's 62 to reduce the number of tapswitch operations both in fulfilling the VAr bias requirements described in U.S. Pat. No. 5,541,498 and for other regulation of substation output voltages where VAr bias is not used.

Figure 2:
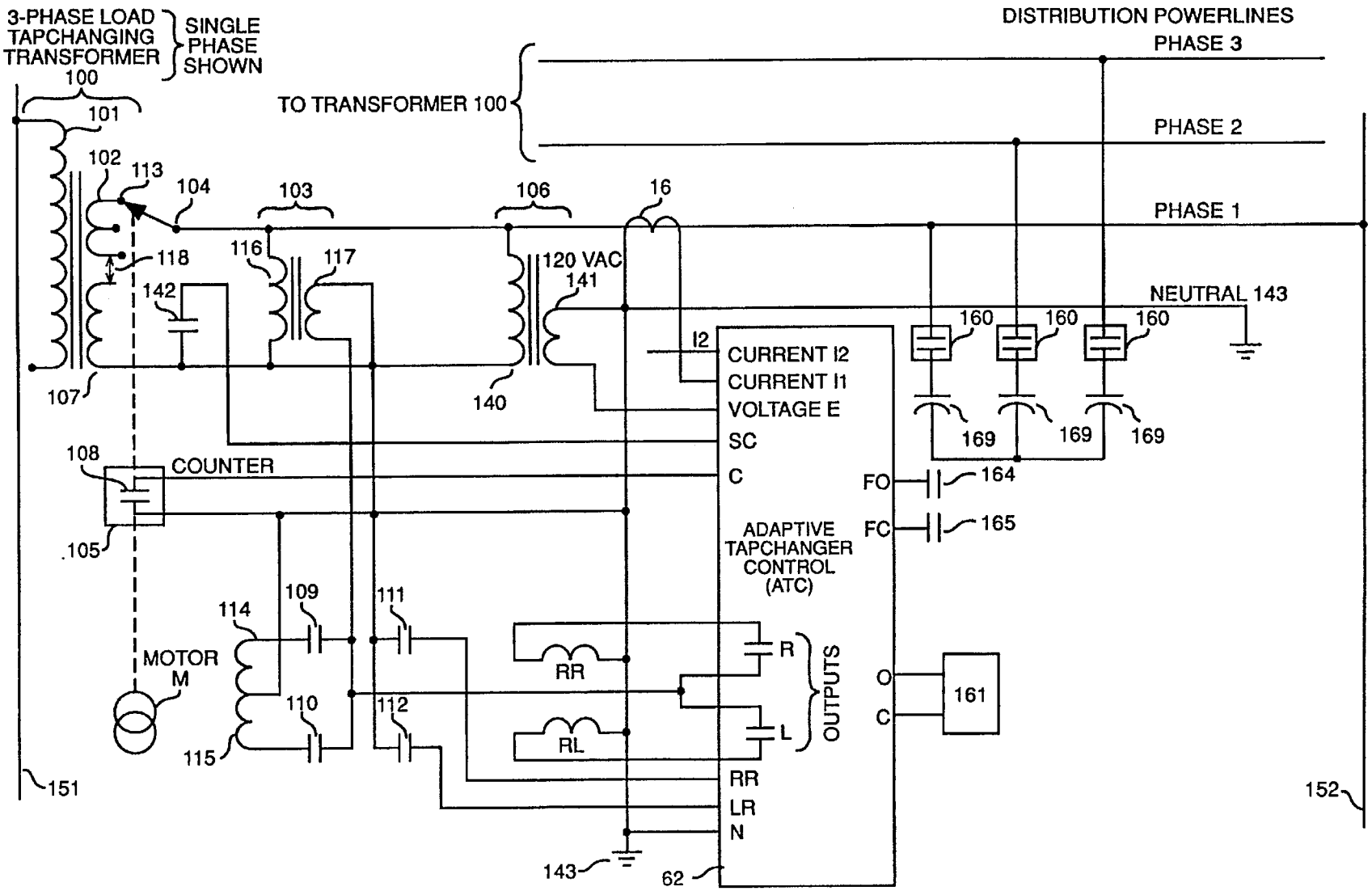

FIG. 2 expands the substation portion of FIG. 1 to show the switching of substation capacitor banks. Three phase bus 151, shown in single phase form, feeds power to transformer 100. Bus 151 voltage is generally at higher voltages of 765 to 230 kilovolts at a transmission substation and 120 to 69 kilovolts at a distribution station. Three phase bus 152, shown in single phase form, is connected to the regulated output voltage of transformer 100 so as to feed more than one line radiating outward. Secondary bus voltage is generally at higher voltages of 230 to 69 kilovolts at a transmission station and at intermediate voltages of 4 to 34 kilovolts at a distribution station.

The term "wheeling of electric power" refers to the practice of electric utilities to competitively sell power to customers not directly fed by the selling utilities' transmission lines. The 1994 Energy act encourages utilities to wheel power through their transmission lines. Capacitors 169 are often used at transmission stations to supply the VArs required by the wheeling of power through transmission stations. Prior art practice has been to switch the capacitors CLOSED and OPEN as required to maintain the voltage level which otherwise tends to lower as the result of power wheeling. Prior art LTC controls then corrected for the voltage increase as the capacitors 169 switched OPEN and for the decrease in voltage as capacitors 169 switch CLOSED. Under prior art practice, coordination of capacitor 169 switching control and LTC transformer control is difficult and leads to excessive LTC transformer switch operations. The present inventive ATC 62 solves the problem by combining the control of capacitors 169 switching with the control of tapswitchs 104 switching (as described in greater detail hereinunder.) Capacitors 169 are switched OPEN by ATC 62 outputs O operating switches 160 via sequencing apparatus 161. Capacitors 169 are switched CLOSED by ATC 62 outputs C operating switches 160 via sequencing apparatus 161.

Capacitor banks at transmission substations generally have more than one section of capacitors 169 which are sequentially switched OPEN and CLOSED by successive operations of ATC 62 output contacts Open and Close. Often feedback contacts 165 are provided to ATC 62 which are closed when all capacitor 169 sections are CLOSED. In addition, feedback contacts 164 are provided to ATC 62 which are closed when all capacitor 169 sections are OPEN. A capacitor section sequencing apparatus 161, as known in the art, is utilized.

The combined control of tapswitch 104 and distribution substation bank capacitors 169 is accomplished by ATC 62 in the same way as described above for transmission substations. Selectively ATC 62 also provides the inventive raising and lowering of substation output voltages to influence ACC switching of capacitors 119 located on distribution lines fed by the distribution substation. The joint control of tapswitches 104, substation capacitors 169 and distribution line capacitors 119 by ATC's 62 is described in greater detail hereinunder.

FIG. 3 shows a power distribution substation circuit providing ATC 62 of regulators 150. Note that one regulator 150 is shown in detail regulating voltage Ein to phase 1 of distribution powerlines with two additional regulators 150 shown in abbreviated form regulating voltages on phases 2 and 3 of the distribution powerlines. Regulator 150 has an input voltage Ein, typically 7800 VAC phase to ground, with the output regulated upwards and downwards by single phase tapswitch 104. Regulators are generally used in sets of three, one per phase, and each with separate ATC's 62, as shown in FIG. 3. These may be applied to the output of a distribution substation feeding each of several three phase distribution feeders or may be placed midway on long feeders to reregulate the three phase voltages beyond that point. Tapswitches 104 are driven by motors M having drive mechanisms 105 with counter contacts 108; counter contacts 108 closing briefly when each tapchange is mechanically committed. Motors M drive mechanisms further have contacts 142 closed only on a neutral tap position where the voltage Ein is equal to the phase voltage leaving the regulator. Motors M are powered by single phase transformers 103 having primaries 116 receiving voltages from phase to neutral 143 of the voltage controlled output of regulators 150 via secondary 117 generally at 120 Vac. Motors M may have windings 114 which, when powered, cause motors M to run in the direction of increasing tap positions and having windings 115 which, when powered, cause motors M to run in the direction of decreasing tap position. In any instance, motor direction is obtained by use of one or the other of two contact closures, R and L. Transformers 106 provides 120 Vac from secondary windings 141 to the LTC ATC 62 in response to primary 140 connections between phase 1 and neutral 143. The ATC's 62 provide output raise (R) contact and lower (L) contact which correspondingly operate motors M. Transformers 106 are often included in regulators 150.

FIG. 3 further shows a typical pole-top capacitor installation of ACC's 139 together with phases 1, 2, 3 and neutral conductors of power distribution lines fed from the power distribution substations. Neutral conductors are shown connected to the substation ground circuitry. Phases 1, 2 and 3 are shown connected to regulators 150. ACC's 139, as shown, receive power from phase 1 through stepdown transformers 138. Note that at other capacitor locations, transformers 138 may alternatively be connected to phase 2 or phase 3, however it is general practice to switch all three phase capacitors with a single ACC sensing one of three phases.

Power factor correction capacitors 119 are shown connectable through switches 120 to distribution circuits phases 1, 2 and 3. The ACC 139 selectively closes circuits from the ACC 139 terminal Hot (H) to Close (C) to operate magnetic devices part one 121 thereby closing switches 120 and connecting capacitors 119 to the distribution powerlines. Selectively the ACC's 139 close circuits from the ACC 139 terminals H to O to operate magnetic devices part two 122 thereby opening switches 120 and disconnecting the capacitors 119 from the distribution powerlines.

After devices 121 have performed their closing function, they latch closed with contacts 123 and contacts 124 open, removing power from the devices 121. After devices 122 have performed their opening function, they latch open and contacts 123 open, removing power from the devices 122. ACC's close contacts Close and Open for sufficient time for the latching to occur.

Figure 4:
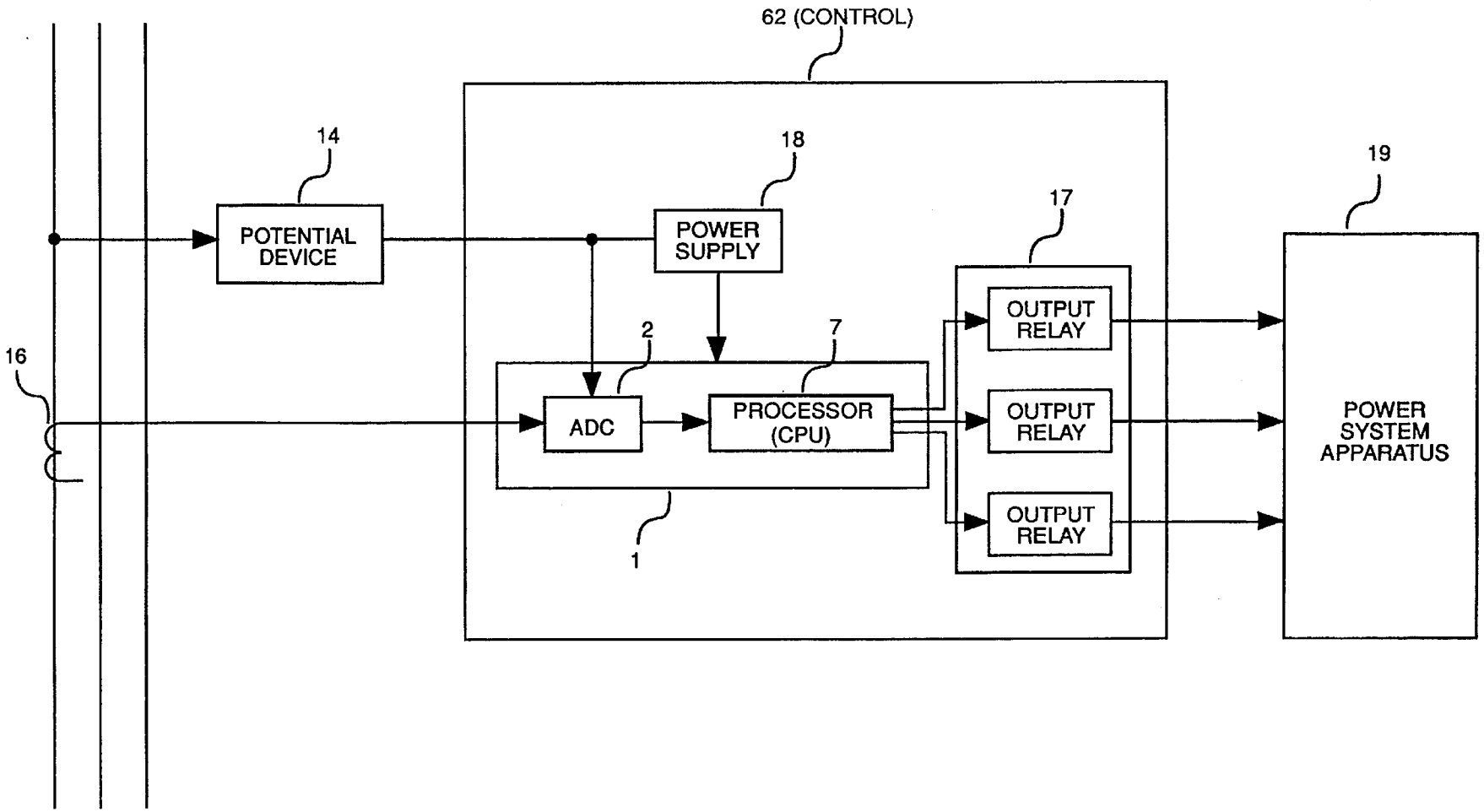
FIG. 4 is a diagram of a system consisting of a potential device and a current transformer providing inputs to an LTC control, in turn having outputs to power system apparatus.

FIG. 4 illustrates ATC 62 having self-contained microprocessor 1 including central processor unit (CPU) 7 with on board memories 4, 5, and 6 (see FIGS. 5, 6 and 7) and also including an analog to digital converter (ADC) 2. Note that the use of on board memories is for descriptive purposes only; the memories may selectively be separate chips. Power supply 18 obtains inputs from potential device 14 and supply power to microprocessor 1. CPU 7 provides outputs to operate relay 17, which is connected to controlled devices. Potential devices 14 also provide input voltages for the ADC's 2 for the purpose of digitizing alternating current (AC) voltage signals from devices 14. Current transformers 16 furnish input current signals to ADC's 2 from one phase of the AC circuits. The current inputs to ADC's 2 are for the purpose of digitizing AC current signals.

All other parts of FIG. 2 are described hereinabove in relation to FIG. 1.

Figure 5:
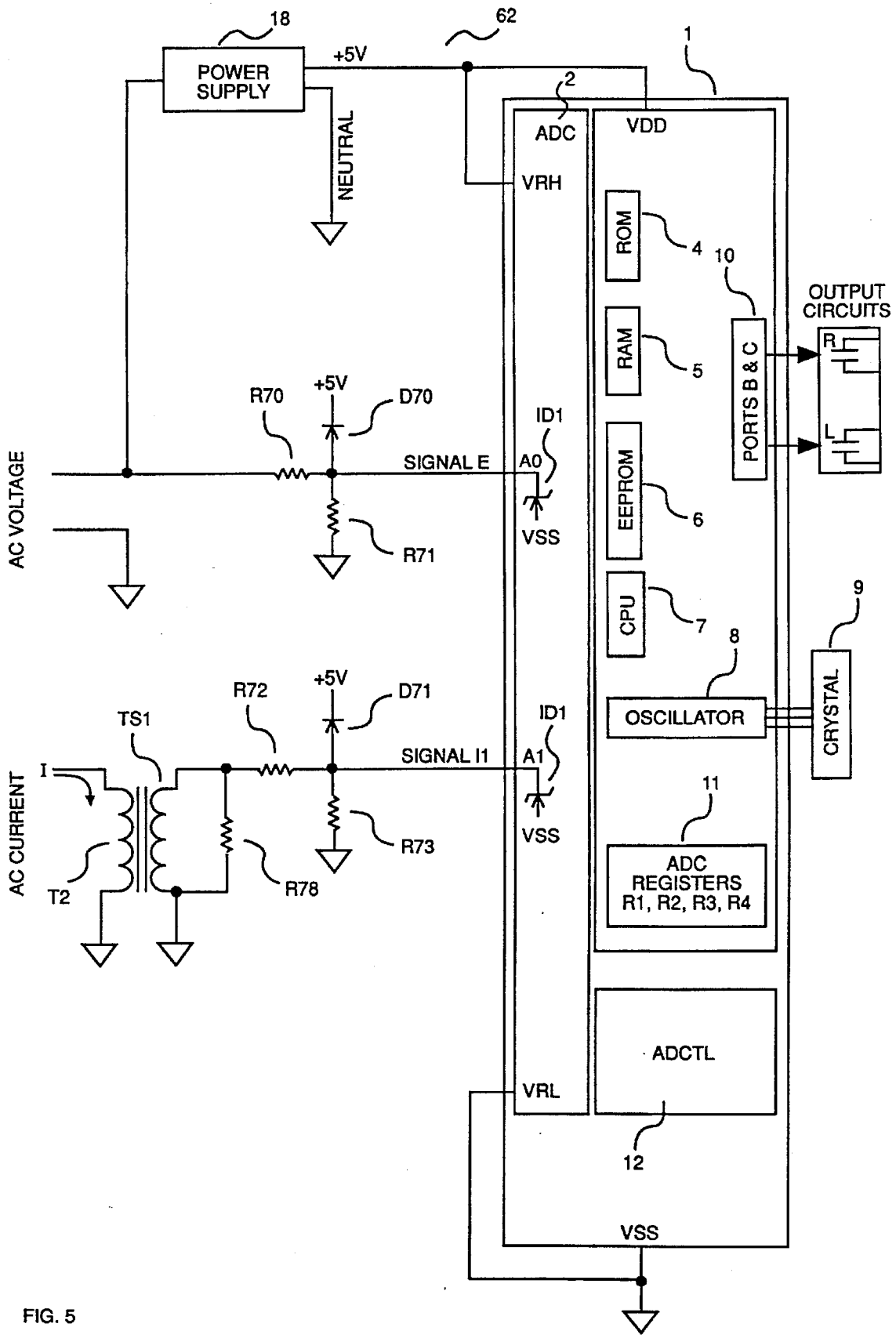
FIG. 5 is a more detailed diagram of a single chip LTC control having a voltage input and a current transformer input using a resistive burden.

The present invention includes a program used by microprocessor 1 for the multiple functions described herein. FIG. 5 is a more detailed circuit diagram of ATC's 62 using single chip microprocessors 1 containing ADC 2; in turn having protective diode ID1, and having the ROM 4 containing programs, RAM 5 and EEPROM 6 memories; further having CPU's 7 and ports B and C 10 respectively driving raise output contacts R and lower output contact L. External crystal 9 and self contained oscillator 8 provide clock frequencies for the microprocessors 1. Analog to digital control logic (ADCTL) 12 controls flow of digital samples from ADC 2 to ADC registers R1, R2, R3, and R4 collectively numbered 11. Power supplies 18 supply +5 V for the VDD supplies as well as the high ADC references VRH of microprocessors 1 and also neutral returns for VSS and low ADC reference of microprocessors 1. The input AC voltages are reduced by resistors R70 and R71 to signal E connected to inputs A0 of ADC 2. AC currents I from current transformer 16 (see FIG. 4) flow through transformers T2 having secondaries TS1 feeding current to burden resistors R78. Voltages across R78 are divided by resistors R72 and R73 so as to yield current signals I1 in turn connected to inputs A1 of the ADC 2. Diode D70 and D71 provide overvoltage protection for ADC inputs A0 and A1. The circuits of FIG. 5 provides half wave digitization of the voltage signals E and current signals I1 in accordance with referenced U.S. Pat. No. 5,315,527. FIG. 5 illustrates use of resistive burden 78 providing a positive half wave signal I1 to ADC input A1. Use of resistive burdens R78 provides signals I1 which are in phase with signals E.

Figure 6:
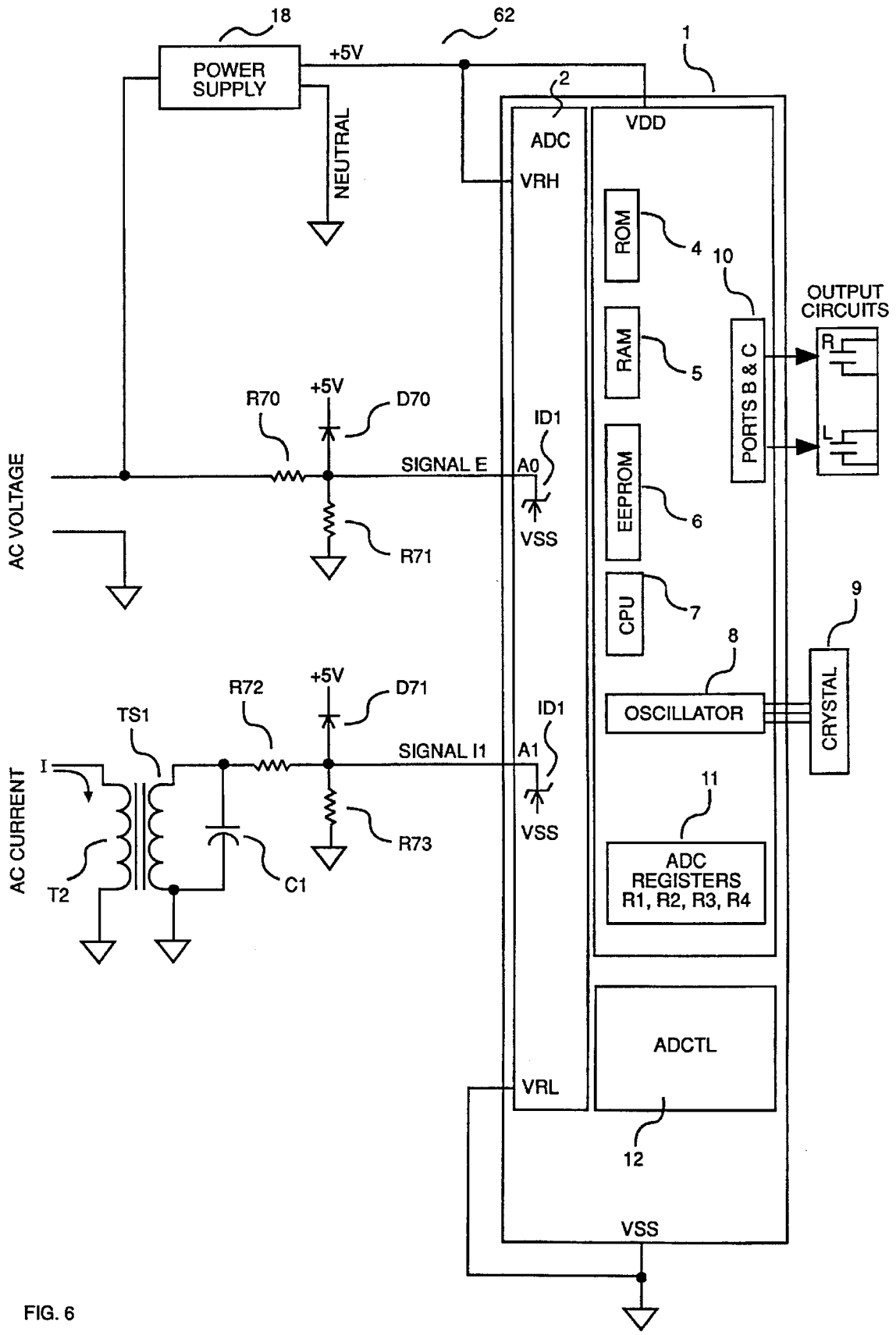
FIG. 6 is a more detailed diagram of a single chip LTC control having a voltage input and a current transformer input using a capacitive burden.

FIG. 6 is identical to FIG. 5 with the exception of the replacement of resistive burdens R78 of FIG. 5 with capacitive burdens C1 of FIG. 6. The voltage across C1 due to current I is 90° leading with respect to signal E. The voltage is divided by resistors R72 and R73 as in the circuit of FIG. 5 forming signal I1. Use of capacitive burden C1 on current transformer T1 gives 6 decibels per octave attenuation of current signal harmonics so as to more nearly respond to the fundamental component of the current signal when desired. Other components shown in FIG. 6 function as described above in relation to FIG. 5.

Figure 7:
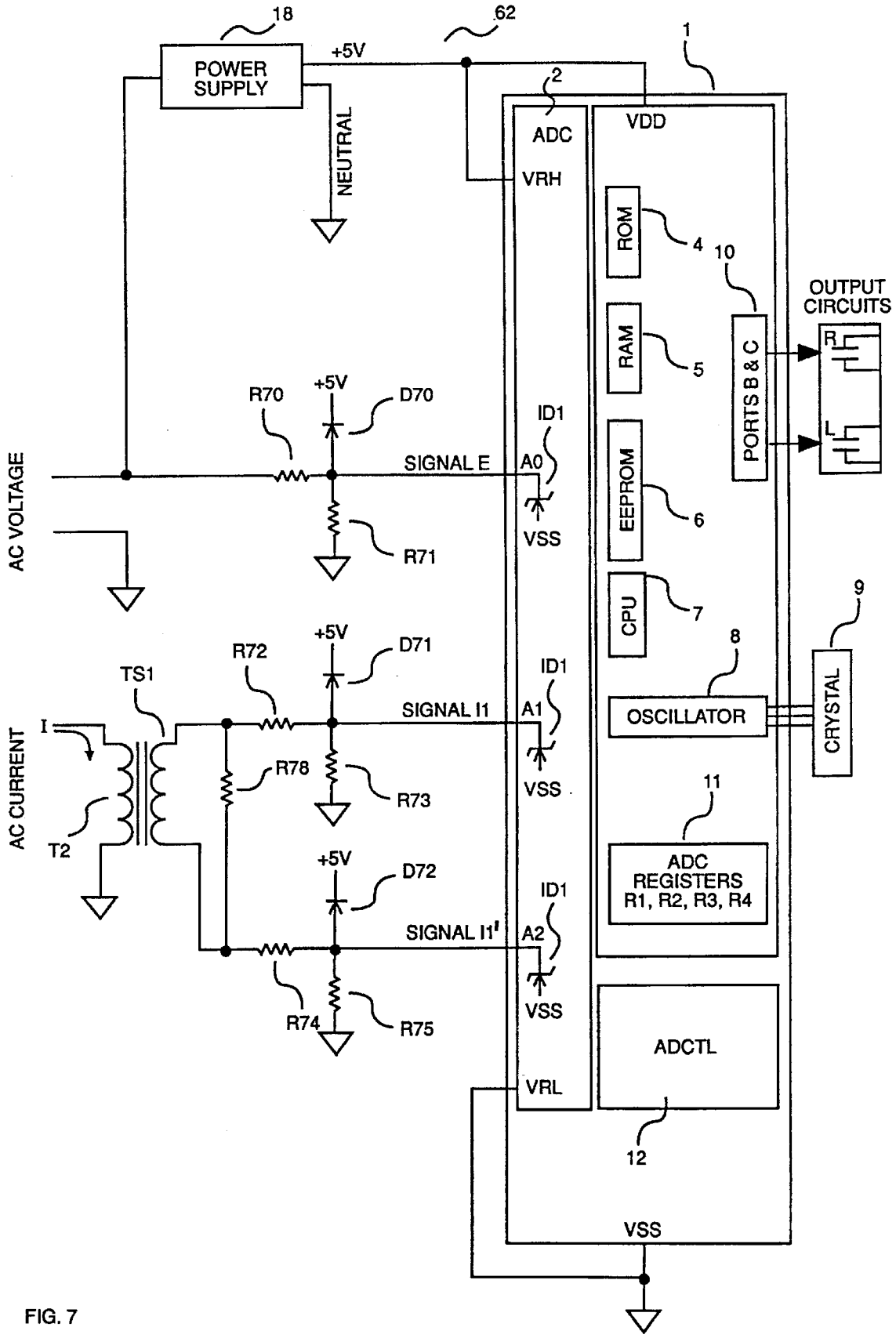
FIG. 7 is a more detailed diagram of a single chip LTC control having a voltage input and a center tapped current transformer input using resistive burdens and providing two ADC inputs for measurement of the entire current signal.

FIG. 7 is also identical to FIG. 5 except that voltages across winding TS1 are divided by resistors R74 and R75 forming signals I1' in phase opposition to signals I1. Signals I1' are protected from overvoltages by diode D72 and fed to ADC inputs A2 thereby providing for analysis of both polarities of current I.

Figure 8:
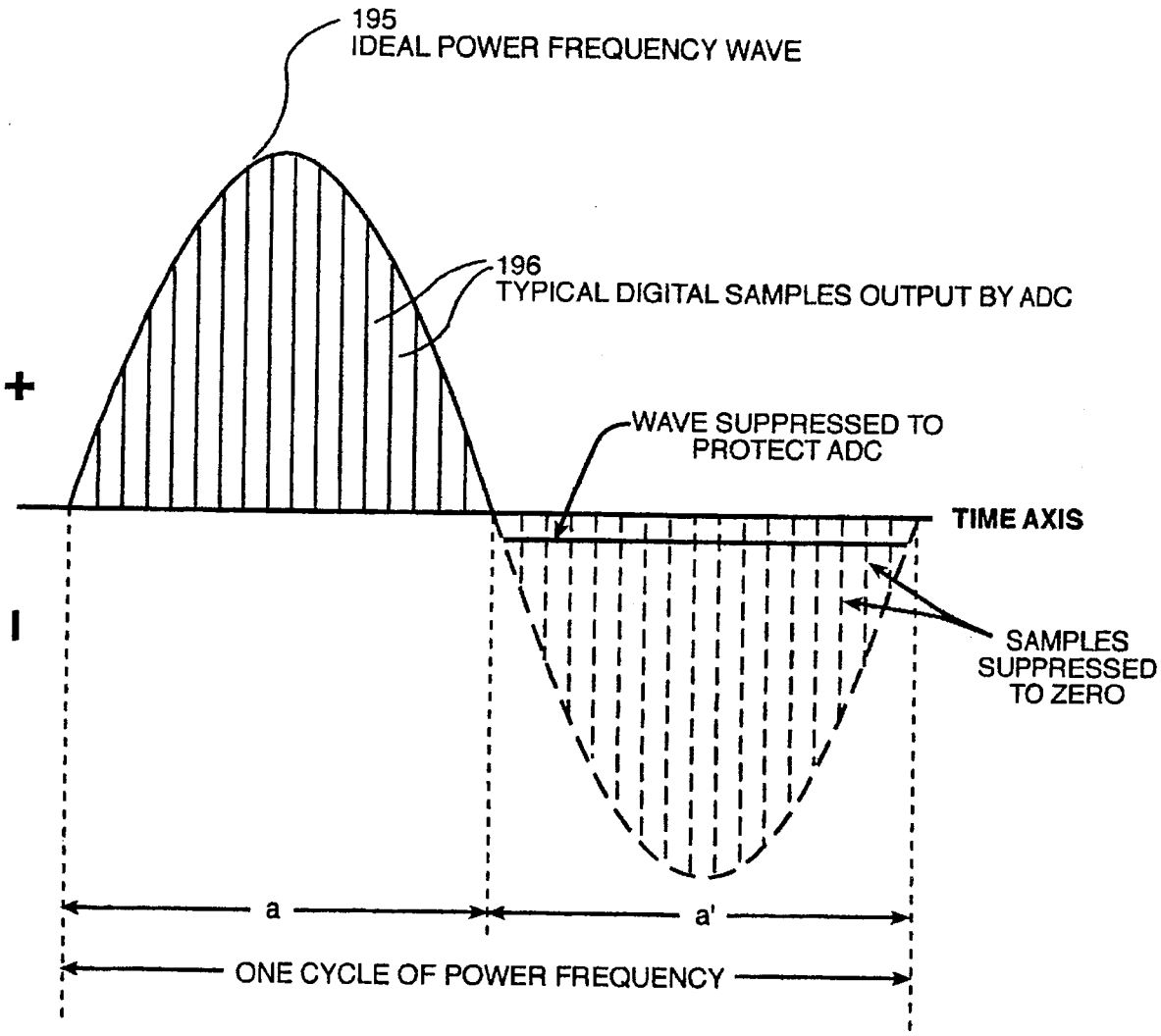
FIG. 8 is a diagram showing one cycle of AC voltage and current waves wherein the positive half cycle is sampled and the negative half cycle is suppressed and, if sampled, yields samples whose values are zero.

FIG. 8 summarizes the sampling of the positive half cycle, a, of AC current and voltage waves 195 as described in referenced U.S. Pat. No. 5,315,527. Positive half cycles of wave 195 are sampled by ADC 2 and samples 196 are output to CPU 7 of microprocessors 1 (FIG. 5, 6 and 7). Negative half cycles, a', of wave 195 are suppressed by ID1's to protect ADC 2 and any ADC samples taken during these periods are zero.

Figure 9:
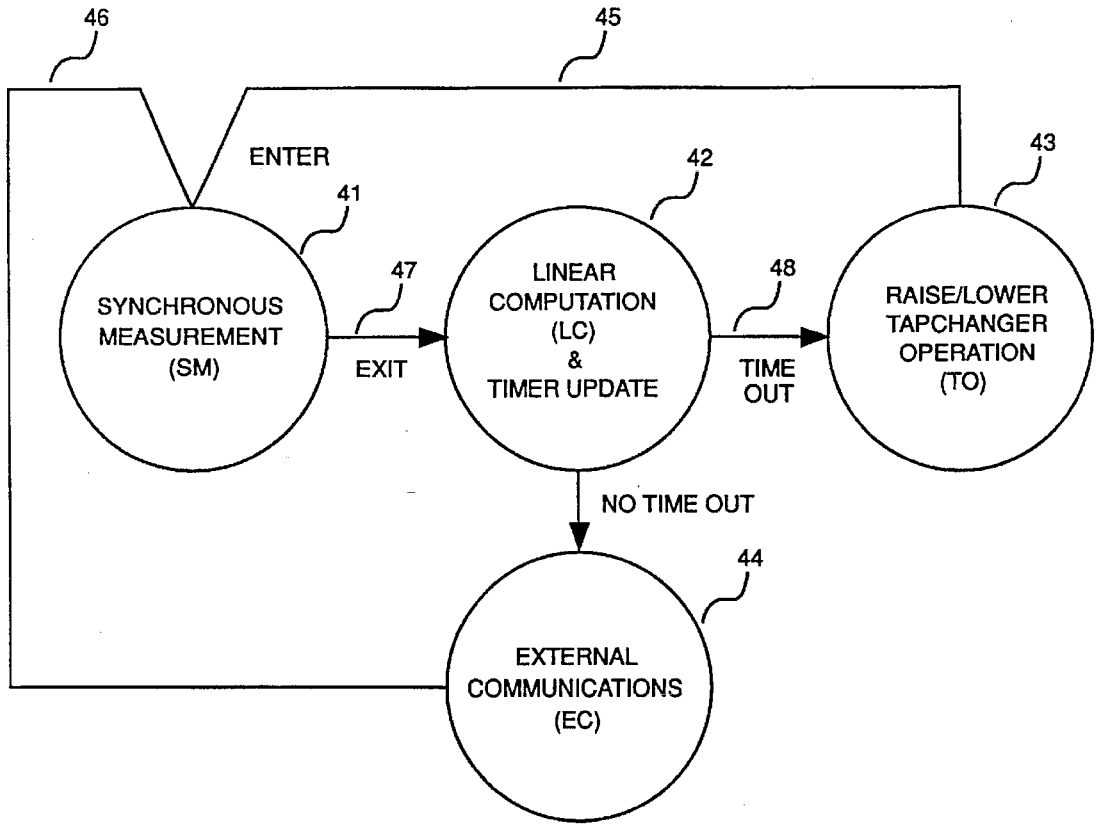
FIG. 9 is a flow diagram describing the SLIM programming method, useful in LTC controls, for obtaining measurements of an AC wave, making computations, performing tapchanges and communicating to a computer network.

The half wave technology of U.S. Pat. No. 5,315,527 and the synchronous programming (SLIM) technology of U.S. Pat. No. 5,544,064 are utilized in the present invention to obtain the benefits of the improved resolutions of signals E, I1 and I1'; the reductions in components needed; and, the resultant improvements in reliability and the reductions in cost. FIG. 9 summarizes the SLIM technology showing that subprogram 41 takes samples from ADC 2 (FIGS. 5, 6 and 7 herein) in synchronism with a free-running rate of signal conversions by ADC 2. When not taking samples, preferably during negative half cycles of input AC signals, the program progresses linearly (one task at a time) via paths 45, 46, 47 and 48, as required for computation by subprogram 42, to communicate via subprogram 44 and to control tapchanging and capacitor switches via subprogram 43.

Use of the SLIM technology is preferred since it makes possible the use of rugged, although relatively slow, microprocessors as used in the automotive industry. The SLIM technology results in programs that are very short so that even at microprocessor clock speeds in the order of two megahertz, 240 samples per half cycle are obtained due to the relatively quick running time of the short programs. The entire program for the inventive ATC's requires from 5000 to 10,000 bytes of ROM for storage. The program loops run continuously without interrupts and each loop uses but a portion of the total program at a time.

The various features of this invention utilize the program described herein. Comparable programs using prior art technology may require 10 to 20 times the memory space and run 10 to 20 times slower in terms of clock cycles. It is to be understood other microprocessors and larger programs, are useable to obtain the inventive apparatus and methods described hereinbelow. However, the technologies disclosed in U.S. Pat. Nos. 5,315,527 and 5,544,046 are preferred and are used hereinbelow in describing the invention.

MEASUREMENT

Figure 10:
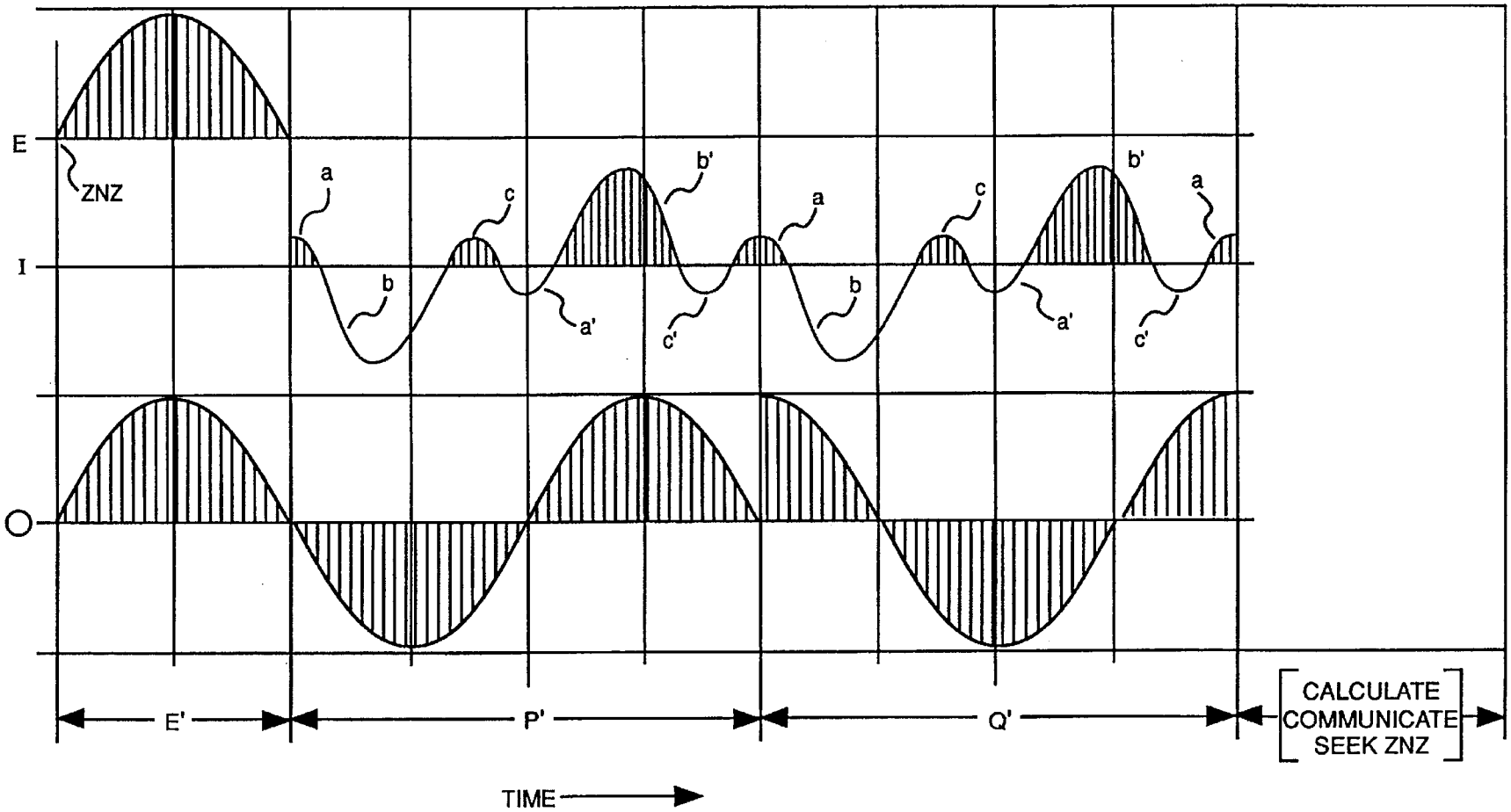
FIG. 10 shows voltage and current time lines for measuring voltage amplitude and combining with half wave current signals using a resistive burden to obtain Watts and VArs.
Figure 11:
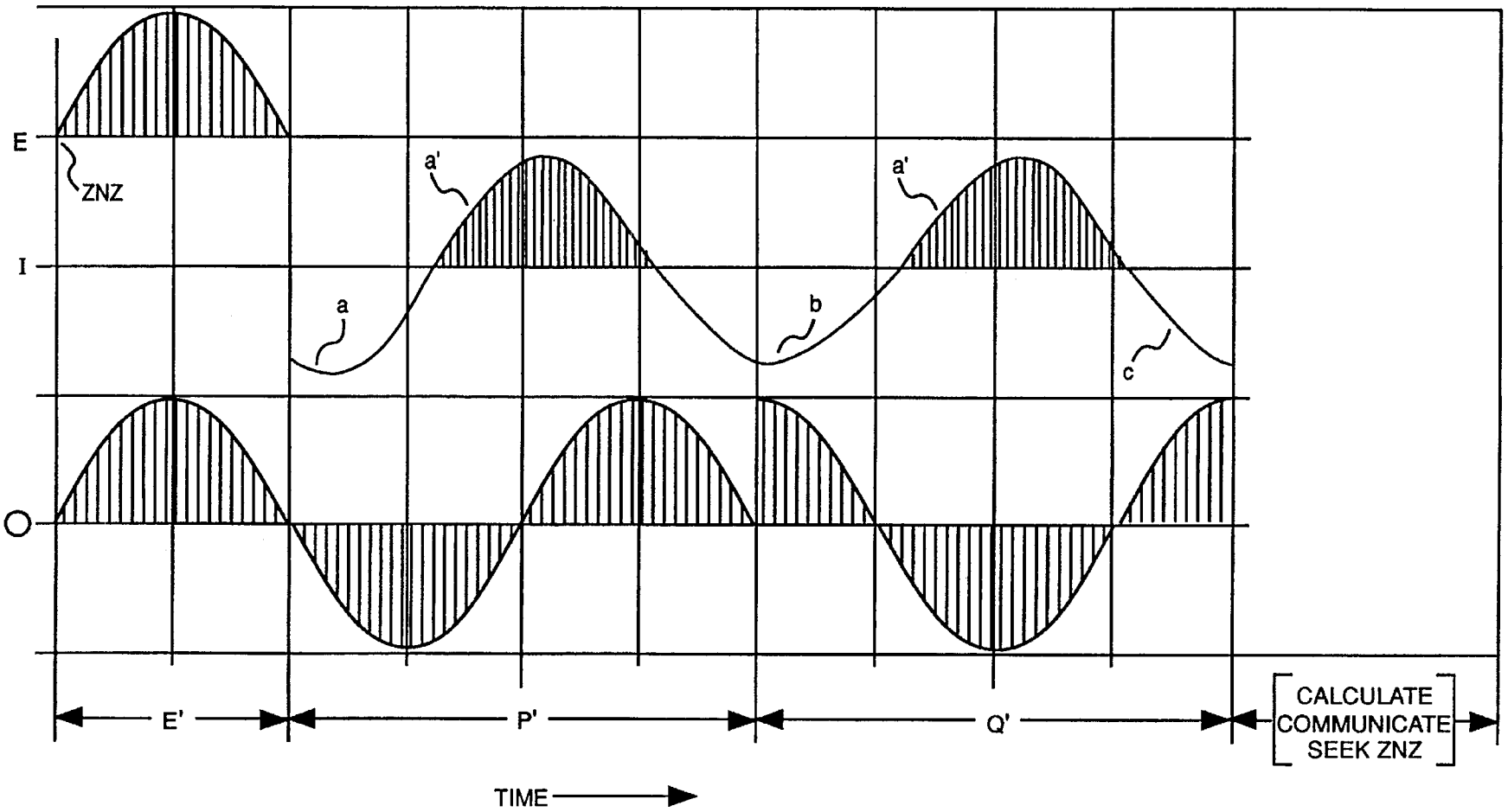
FIG. 11 shows voltage and current time lines for measuring voltage amplitude and combining with a half wave current signal using capacitive burdens to obtain Watts and VArs.
Figure 12:
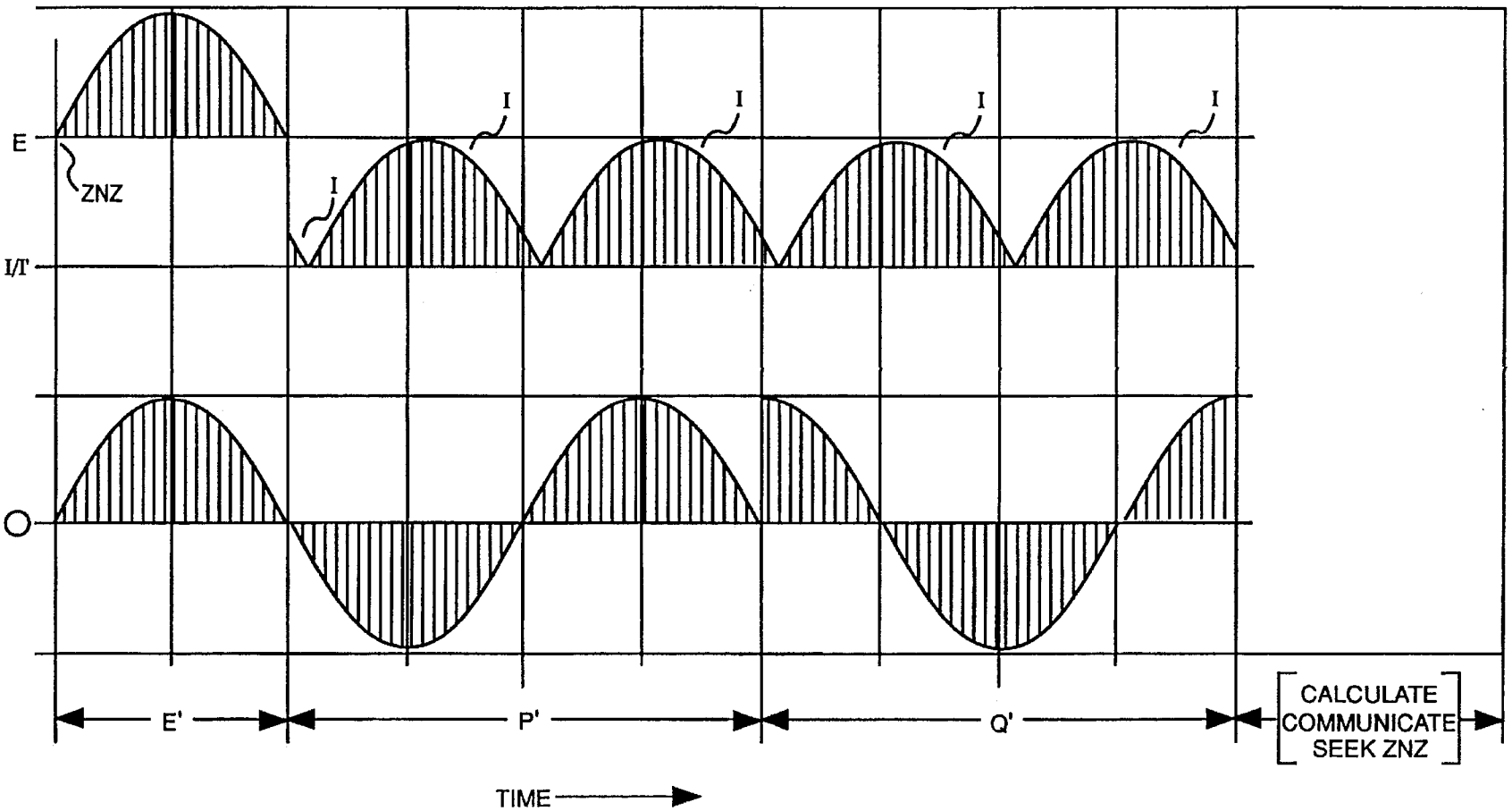
FIG. 12 shows voltage and current time lines for measuring voltage amplitude and combining with a full wave current signal using resistive burdens to obtain Watts and VArs.

FIGS. 10, 11 and 12 show the measurement of the fundamental components of voltage signal E during one half cycle designated as time period E', the measurement of the real (P) component of a current signal I1 during the next full cycle designated as time period P', the measurement of the quadrature (Q) component of the same current signal I1 during a succeeding full cycle designated as time period Q', with a final half cycle designated as time period CALCULATE COMMUNICATE SEEK ZNZ for computation, communications, and resynchronizing with the next zero to non-zero (znz) transition of voltage signals E. The programs runs synchronously with the ADC's from the initial znz detection of voltage signals E to the end of 2½ cycles. The only instruction required from the program to the ADC is to change from signal E to signal I at the end of time period ←E'→. These measurements and the time slot for communications occur at the rate of 20 per second for a 60 Hz power frequency.

The expected values of P range from a positive maximum to a negative maximum. Negative values indicate a reversal of power flow and is useful in reversing the operation of ATC's 62 should there be a reversal of power flow as sometimes occurs when regulators are used at midpoints of distribution lines alternatively fed from either of two points.

The possible values of Q also range from a positive maximum to a negative maximum. At a distribution substation, negative values indicate an excess of capacitive correction of inductive loads.

Computed values of power factor from P and Q obtained using the inventive measurement described herein are found to be an order of magnitude more accurate than obtained by present technology method using 16 samples per cycle.

A second current not shown can be added and alternatively switched in place of current I1. This provides measures of real, P, and reactive, Q, power from the second current. For example, P and Q can be used to obtain the phase relation between the current and voltage E as a reference.

P and Q determinations from two currents may be processed to establish the relative phase relation between the two currents as required for the daisy chain paralleling disclosed in referenced U.S. Pat. No. 5,530,338. Most conveniently, the ratio P/Q as computed using a first current is compared to the ratio P/Q computed using a second current. The algebraic sign of the difference in the two ratios is an indication of which current leads the other in phase relation to the common voltage E. When the ratios are equal, the two currents are in phase with each other. When all pairs of currents are in phase around a ring of transformers operating in parallel, as indicated by equality of P/Q ratios, the paralleled transformers are operating with minimal losses introduced by paralleling as disclosed in greater detail in reference U.S. Pat. No. 5,530,338. The equality of P/Q ratios as the indication of most efficient operating point is generally true with secondaries of the transformers in parallel even though the primaries are not.

Note that measurements related to each of two currents are available at the rate of 10 per second by programs alternating between the two currents. The communications time windows, however, are provided after each current measurement and therefore at the rate of 20 per second for a 60 Hz AC frequency. Note that with either one or two currents, extended periods of time can be measured by incrementing a count during each of 20 computation times per second, providing a time measurement resolution of three AC cycles. In applications of the ATC's where only voltage need be measured once per cycle, cycles may be counted giving a timing resolution of one AC cycle.

Figure 13:
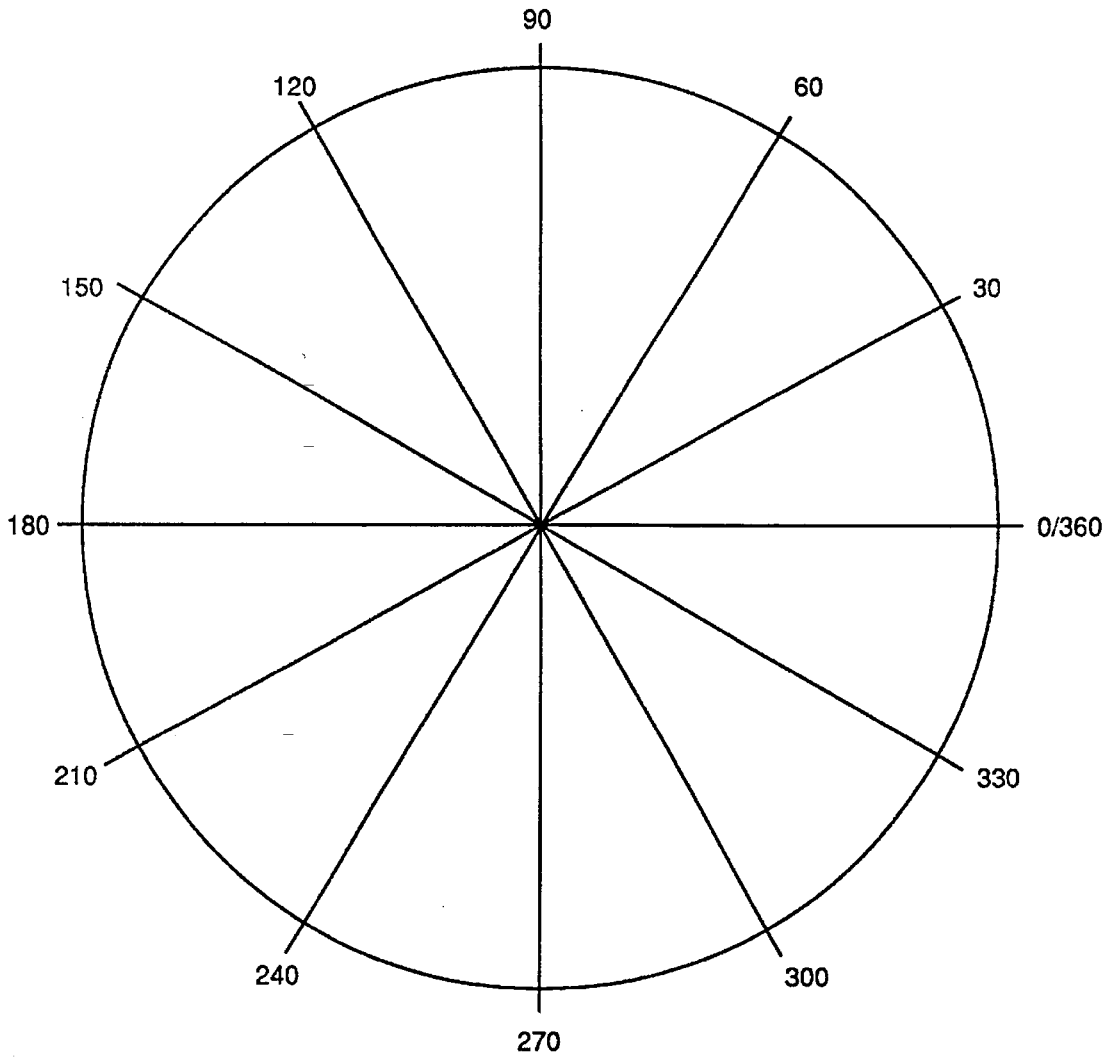
FIG. 13 illustrates a list of values of the sine of an angle arranged to be read in a circle divided into 12 sectors each having the same number of equally spaced values.

In the following discussion of FIGS. 10, 11 and 12, the voltage wave E is shown only in the first half cycle of time where its amplitude is measured. Current waves are shown in the next two full cycles of time where P and Q are measured. Values from the circular table of FIG. 13 are shown along time line indicated by the arrow line in FIGS. 10, 11, and 12 by lines following the profile of values as they are used in measuring P and Q as described in greater detail hereinunder.

FIGS. 10, 11 and 12 illustrate three variations of an inventive method of directly measuring Watts and VArs without the conventional necessity of measuring the amplitude of a voltage, the amplitude of a current and the phase angle relation between them and then using trigonometric computations to calculate Watts and VArs. FIGS. 10, 11 and 12 relate to circuits of FIGS. 5, 6, and 7 respectively. By connecting an AC voltage and current to an ADC as shown in FIGS. 10 and 11 only the positive half cycle of each signal is sampled by the ADC in accordance with reference U.S. Pat. No. 5,315,527. The amplitude of the fundamental component of signal E is measured by first finding the zero:non-zero (znz) transition indication of the start of a positive half cycle of signal E. The measurement is accomplished in one half cycle time (marked ←E'→ on FIGS. 10, 11 and 12) recognizing that due to the expected lack of even harmonics of the voltage signal, the negative half cycle is a mirror image of the positive half cycle and therefore contains no additional information to that obtained in measuring the positive half cycle.

FIG. 12 illustrates inventive methods of directly measuring Watts and VArs using the circuitry shown in FIG. 7 with the variation of producing signal I1 in phase with current I and signal I1' 180° out of phase with current I. By connecting an AC voltage and these current signals to an ADC as shown in FIG. 7, the full wave of the current is sampled as shown in FIG. 12. Use of resistive burdens R78 provide measurements responding to current signals including all harmonic components when required.

By switching from one half cycle to the other (from ADC inputs A1 to A2; see FIG. 7) and using timing obtained by a previous sampling of a voltage E positive half cycle, the entire current wave of both polarities of current is analyzed.

Use is made of the ring of S*N values of the sine function shown in FIG. 13. Using a preferred factor S=12, the ring is shown divided into twelve 30° sections having N equally spaced values in each section. These are dividing points generally selected as desirable to effect phase shifts of the sine function relative to signal E as a phase reference. Such phase shifts are required to compensate for placement of potential devices for obtaining voltage signals and current transformers used for obtaining current signals. When used on a three phase system such placement may create the need to correct for a fixed phase shift generally falling in 30° increments. An advantage of use of the table with selectable starting and stopping points is that no distortions or errors are caused by the correction of phase angles as often occurs in prior art analog means for such correction.

Note that any starting and stopping points located halfway around the circle from each other provide a half wave function; when starting at any 30° point and going completely around the circle provides a full wave function; and when starting at any 30° point and going twice around the circle provides a two cycle function.

By using the methods of referenced U.S. Pat. No. 5,544,064, a large number of samples, preferably 240, may be taken during positive portions of signals sampled. This number of samples per half cycle will be used hereinunder in illustrating the principles of this invention. The number of values in the circle corresponds to the expected number of samples of 60 Hz AC signals, that is 480 values for the complete circle corresponding to a full cycle of any signal sampled. Note that the numbers of samples per cycle and matching values of the table for use on a 50 Hz electric power system may differ from the numbers used at 60 Hz.

To properly provide the 30° sections it is necessary that the number of values in the ring be divisible by 12. The case of the example used of matching 240 samples in a half cycle gives N=40 values per 30° segment.

The ring table with entry and exit points at every 30° is entered into ROM memory 4 of the microprocessor 1 (see FIGS. 5, 6 and 7) and values are read in a counter clockwise direction starting at a first selected point and ending at second selected point around the ring as required by any computation. By "starting at any selected 30° point", one means that the first value of the table read is the next one falling counterclockwise around the ring from the selected point. By "ending at any selected 30° point", one means that the last value read is the one just clockwise around the ring from the selected point.

Note that skilled programmers can generate the ring from a smaller table by using known program minimization technology. The inventive concepts are best described herein, however, by assuming existence of a complete ring of values of the sine function.

It is well known that most measured cycles of voltage delivered to users of electric power in the United States will have a distortion of one percent or less. In addition, the voltage output from a controlled device is expected to be essentially at the voltage setpoint value. In light of these observations, values from the ring of sine functions are used in place of actual voltage samples in the inventive process of measuring P and Q.

On the other hand, it is known that current signals may have large amounts of harmonic distortion sometimes causing more than the expected number of zero crossings of the signals. However it is further well known that current signals at the output of power transformers are unlikely to have significant amounts of even harmonic components. In general, therefore, only the positive half wave of current signals are used for non-zero samples in the inventive measurement of P and Q. (An inventive process for using both half waves of current signals is given for exceptional cases where both even and odd harmonics are expected in current waves.)

It is further recognized that the accuracies required in measuring VArs for controlling the switching of power factor correcting capacitors is not great since capacitors are either connected or not connected. This further justifies use of inventive measurement and computation techniques that may have small theoretical errors.

It is necessary to measure the fundamental components of voltages accurately, however, since voltages are used as the means of direct communications between ATC's and ACC's. In both ATC's and ACC's the fundamental component of voltage signals are used as being unaffected by harmonics and the changing distribution of harmonic components of voltages as capacitors are switched.

During periods ←E'→ of FIGS. 10, 11 and 12, the znz transition of signal E is first detected. Thereafter products of 240 samples of signal E and 240 values from the ring starting at 0°/360° and ending at 180° are summed forming a value proportional to the fundamental component of signal E.

The computation of E is stopped after 240 multiplications whether or not a non-zero to zero (nzz) transition occurs in the voltage wave E. The measurement is next switched from measuring the fundamental component of voltage to measuring the power (P) component of controlled unit output.

In FIG. 10 it is assumed that transformer T2 of FIG. 5 has a resistive burden R78 and it therefore is assumed that the real (P) component of current is in phase with voltage signal E. Also since it is known that voltage signal E is being regulated by the ATC 62 to rather close tolerances, an approximation of the real (P) and quadrature (Q) components of power are made by inventively using the FIG. 13 ring of sine functions in lieu of actual samples of voltage signal E.

Therefore during time period ←P'→ samples of signal I are multiplied by 480 values from the ring starting at 180° and ending at 180° and summed forming a value approximating the P component of output from the controlled device.

Immediately after obtaining the approximate value of P and during time period ←Q'→ samples of signal I are multiplied by 480 values from the ring starting at 90° and ending at 270° and summed forming a value approximating the Q component of output from the controlled device.

For greater accuracy, during the ←CALCULATE COMMUNICATE SEEK ZNZ→ period, the values of P and Q may be corrected for the amount the previous measure of the fundamental component of signal E departed from its' expected value. This is done by multiplying the measured values of P and Q by the ratio of the previous measurement of the voltage amplitude by the voltage control setpoint.

In FIG. 10 the current signals I are assumed to be severely distorted and having extraneous zero crossings. Note that during the forming of sums for P and Q that approximately one half of the products are zero. This represents the portions of the save of signal I where due to the assumed symmetry of signal I having only odd harmonic components, no information as to the value of P and Q is lost. For example, portion b giving only zero increments to the value of P and Q is the mirror image of portion b' where true increments are obtained. Likewise portions c mirror c' and portions a mirror a'.

FIG. 11 is similar to FIG. 10 except that a capacitor is used as the burden for current transformer T2. The starting point on the ring is displaced by 90° to compensate for the phase displacement when using a capacitive burden C1 as shown in FIG. 6. The starting points for computations of Q are always offset by 90° from the starting points selected for computations of P.

The measurements of E, P and Q are performed the same as described under FIG. 10 above. Note that in this example, however, that the current wave I is essentially a sine wave due to the 6 decibels per octave attenuation in harmonics provided by the use of capacitive burden C1.

FIG. 12 shows the measurement of full waves of current wave I/I' as provided by the circuit of FIG. 7. The program alternates between ADC inputs A1 and A2 upon detection of a zero sample in either input. Due to the use of resistor burdens R78, it is assumed that the real (P) component of current is in phase with voltage signal E. During time period ←P'→ samples of signal I/I' are multiplied by 480 values from the ring starting at 180° and ending at 180° and summed forming a value approximating the P component of output from the controlled device. As shown in Fig. 12, the values of the ring are shifted 90° by starting at 90° and ending at 90° for use in measuring Q.

COMPUTATION

Figure 14:
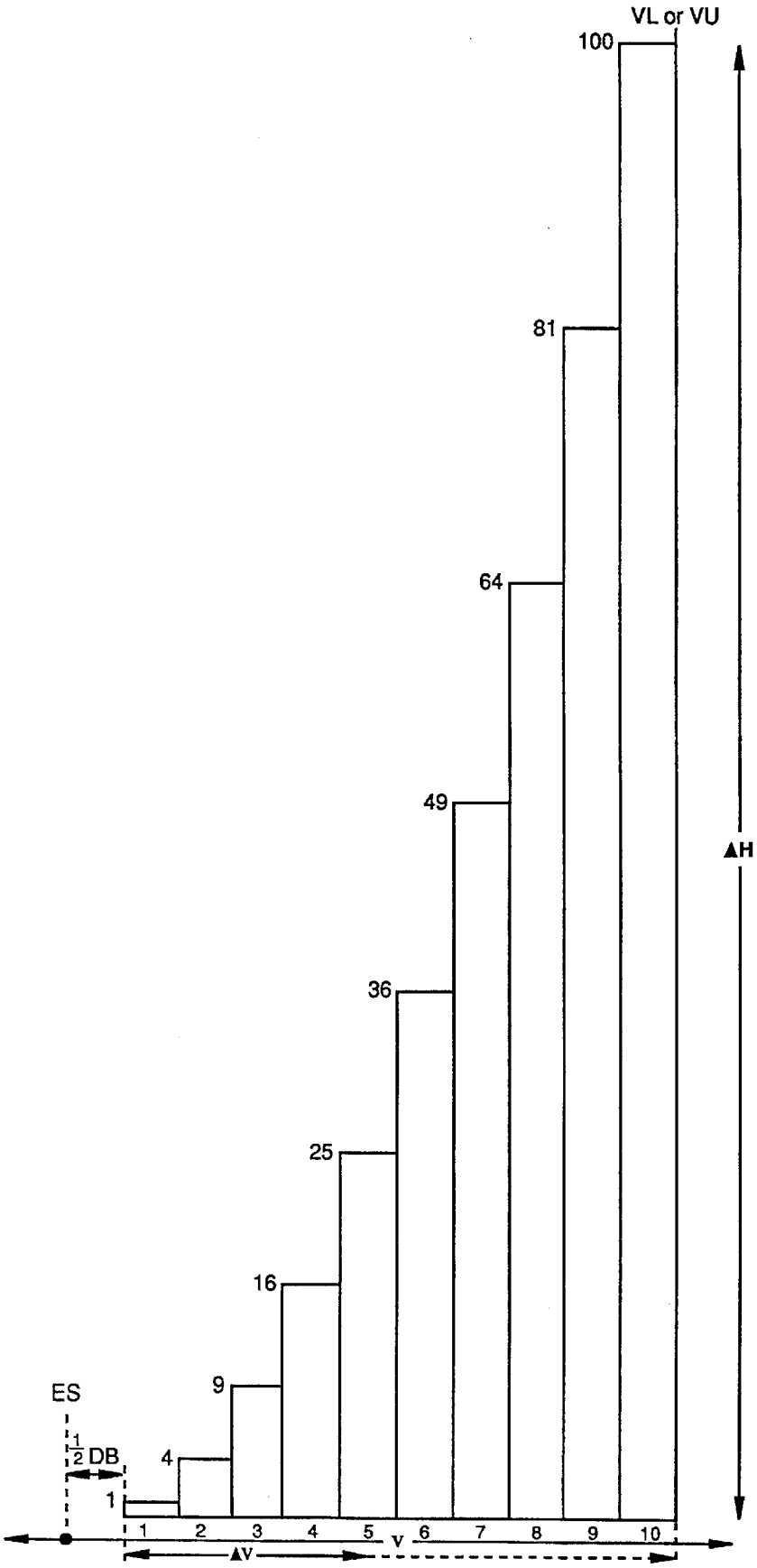
FIG. 14 shows a first representation of ▲H as a function of V−v for v between either V and VU or V and VL as useful in explaining adaptive features of the present invention.

As described in referenced U.S. Pat. No. 5,541,498, FIG. 14 shows the assignment of integer values from 1 to 10 starting with 1 at the upper edge of half deadband ½DB and ending at an upper voltage limit VU. FIG. 14 also shows the assignment of integer values from 1 to 10 starting with 1 at the lower edge of the deadband DB and ending at a lower voltage limit VL. The vertical scale shows the squares of these integers which are used to increment a timing variable H upward by an amount ▲AH following each measurement v of voltage signal E (see FIG. 15) whenever v is between the absolute low voltage limit VL and the bottom of deadband DB (see FIG. 15) and when a raise in tap position may be required should timing variable H accumulate to greater than H', an adaptive time-out limit as described hereinunder. FIG. 14 also shows the use of squares of integers to increment timing variable H upward by an amount ▲H following each measurement of voltage signal v whenever v is between the upper voltage limit VU and the top of deadband DB, when a lower of tap position may be required should timing variable H accumulate to greater than H'. Note that the voltage ranges between the edges of band B and the limits VL and VH need not be equal. These ranges are referred to herein as "nonlinear ranges".

FIG. 14 shows voltages between half deadband ½DB and either VU or VL. As is necessary in any digital process, this voltage range, which is fundamentally analog in nature, is divided into discrete increments. For clarity FIG. 14 shows the voltage ranges divided into 10 increments with corresponding values of ▲H shown ranging from 1 to 100. This number of increments of ▲H is arbitrary, however, and generally will be much larger than 10, say 100, and is given by the term 'm' in the equation:

$$\blacktriangle H = m * X/Y$$

where:

X=v−(V−½DB) and denominator Y=VU−(V+½DB) when voltage v is above the deadband DB, and X=(V−½DB)−v and denominator Y=(V−½DB)−VL when voltage v is below the deadband DB, where V is the voltage at the center of band DB and v is any measured voltage E (see FIGS. 10, 11, and 12).

In order to reduce the size of a microprocessor program using these equations, it is desirable to avoid floating point mathematics and use only integral numbers. Note that X/Y will range from 0 to 1 in value. Since integer numbers are rounded down to the next lower integer, the integer value of X/Y will be zero except at the limit value where X/Y=1. For this reason the product m * X is computed first. An examination of the function m * X/Y so calculated shows that either m or Y will determine the number of integer values obtained for ▲H, depending on which is the smaller, m or Y.

Now X and Y are obtained from values of voltage from a measurement process. The measurement described herein and in referenced patents and patent applications provides a typical resolution for Y of 2700 discrete integer values. With a choice of m=100, m will therefore determine the resolution of the graph of FIG. 14 into 100 bars for most positions of v between VL and VU. Only where v is very close to either VL or VU will the number of bars be determined by a value of Y which is smaller than m.

Thus an integer, preferably starting with 1, is assigned to each increment, progressing from the bandedges to VL or VU. Whenever the voltage, v, is measured within a nonlinear range. Timing variable H is incremented upward by the square, ▲H, of the integer number of the increment.

This invention is not limited to the use of the square relation between ▲H and the increment number. A second choice is the cube or another power, not necessarily an integral power. A third choice is to double ▲H in each progression upward in the number of the increment. A fourth choice is to have a table of values of ▲H chosen with no particular mathematical relation to the number of the increment. The invention is not limited to these choices.

Whenever the measured voltage, v, is within the deadband DB, timing variable H is decremented by a selected amount per calculation period.

The inventive process improves its speed of response to voltage deviations non-linearly as the deviations approach operating limits. In contrast to the invention, prior art controls generally have a fixed time response to voltages outside of a deadband.

In other embodiments of the inventive ATC 62, AC current inputs to the ATC are required along with related measurements of the currents and a voltage.

Figure 15:
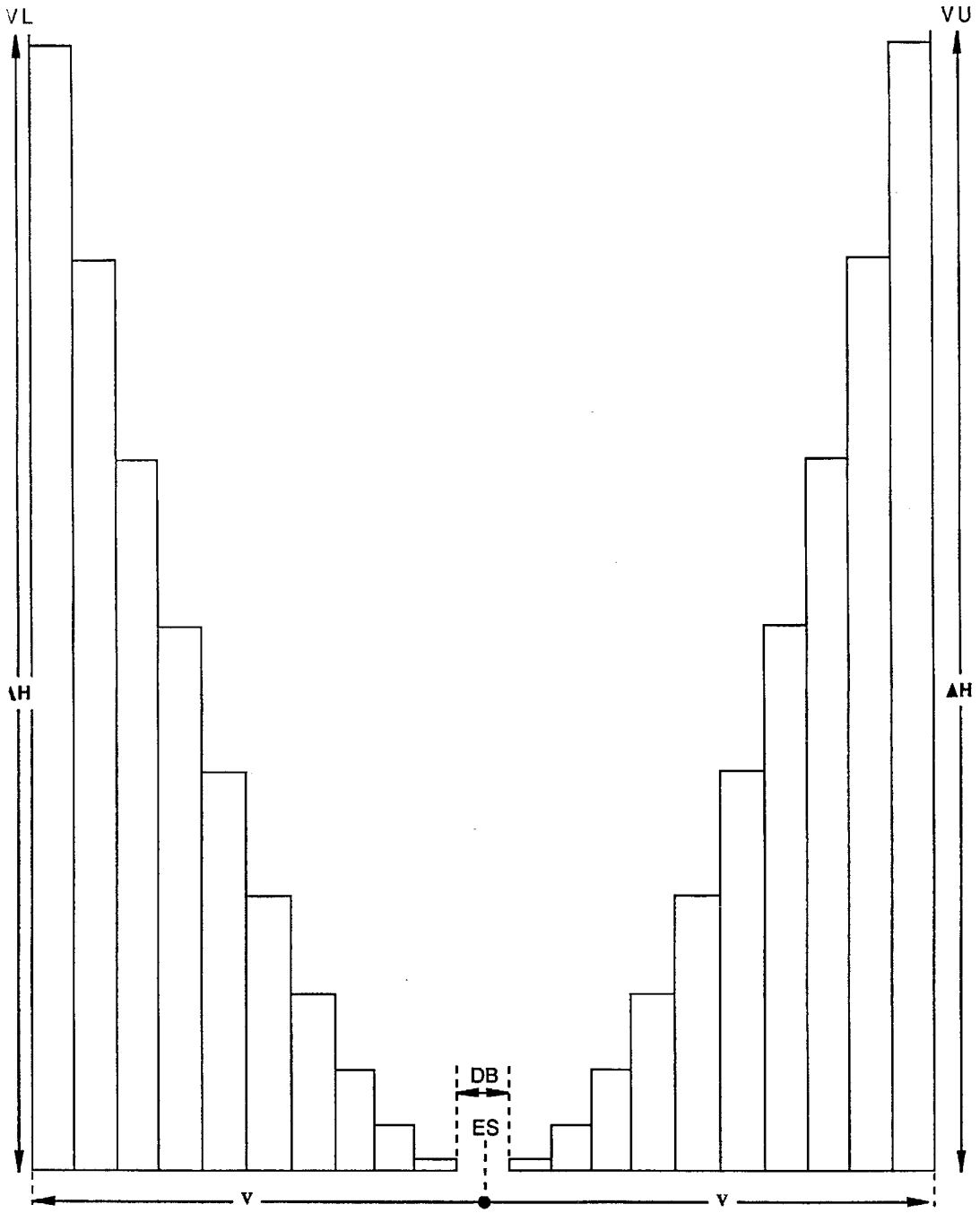
FIG. 15 shows a second representation of ▲H as a function of V−v for v between either V and VU or V and VL as useful in explaining adaptive features of the present invention.

As illustrated by FIG. 15, a timing variable H increments by ▲H after each voltage v measurement computed as the square of the integer assigned to the voltage ▲v deviation from the top of the deadband DB to the upper voltage limit VU or whenever the voltage v measurement is between the bottom of the deadband DB and the lower voltage limit VL. Timing variable H decrements whenever the voltage v measurement is within the deadband DB but timing variable H never decrements below zero. Timing variable H resets to zero whenever the voltage v passes through the deadband DB and after output raise (R) and output lower (L) operations. Whenever time-out occurs by H≧H' the ATC 62 issues a raise command (R) if the time out occurs for voltages v below the deadband DB and a lower command (L) if the time out occurs for voltages v above the deadband DB.

The inventive ATC 62 is capable of maintaining a given quality of voltage regulation with less switch operations than prior art LTC controls. Conversely, using the same average rate of tapswitch changes, the inventive ATC 62 is capable of better voltage regulation than prior art controls.

The time out limit H' adapts daily to a value producing a desired balance between the rate of tapswitch operations and the voltage regulation quality factor (VRQF). This desired balance is selectively accomplished in one of three ways:

a) a voltage regulation quality factor VRQF is chosen to satisfy user requirements, such as to meet state statutes limiting voltage variation. The VRQF is then input to the ATC and the resultant rate of tapchanges is accepted as an operating requirement.

b) a desired daily number of tapchanges as averaged with a time constant of one week is input to the ATC and the VRQF accepted as adequate.

c) by considering the cost, T$, of tapswitch operations, by considering the cost, R$, of poor quality of voltage regulation and by then minimizing the total cost.

Note that several volts are often allowed between the voltage measured at a ATC location and the lower statute voltage limit (generally 114 VAC) to take into consideration the voltage drop between the electric utility distribution lines and the actual customer loads.

The ATC's digitally increments timers, H, as the square ▲H of deviations ▲v of sensed controlled device output voltage outside of a deadband DB. The timer, H, is decremented linearly whenever the regulated device output voltage is within the deadband DB. Timing variable H is reset to zero and the control function changed from raise (R) to lower (L) as appropriate whenever the sensed voltage passes entirely through the deadband DB. A tapchange is made when the value of timing variable H reaches or exceeds H'. Limit H' is adaptively set higher or lower, preferably once per day, so as to produce the selected one of the aforementioned balances. With a), equal VRQF, as the choice the ATC has been found to reduce the average rate of tapchanges by a factor of 40% as compared to prior art tapchanger controls. See the test results given at the end of this document. This extends the operating life of the switches thereby decreasing the number of times transformers and regulators must be taken out of service for maintenance.

SYSTEM VAR MANAGEMENT

Using both the controlled voltage and the load current as inputs, the ATC's directly measure the regulated output Watts (P) and VAr (Q) components. The ATC's then lower the voltages as necessary when used at a distribution substation to induce ACC's to switch CLOSED to provide a reduction in the lagging VArs out of the controlled device. The ATC's also raise the voltage as necessary to induce ACC's to switch OFF so as to provide an increase in lagging VArs out of the controlled device. The net effect of this action is to automatically maintain the VArs passing through the controlled device within an established VAr deadband. These inventive means and methods are described in greater detail hereinbelow.

As revealed in above referenced U.S. Pat. No. 5,541,498 an LTC transformer voltage is biased upward to influence distribution capacitors to switch OPEN at locations where the voltage is the highest and biased down to influence the capacitors to switch CLOSED at locations where the voltage is the lowest. This desirable effect is obtained without the requirement for external communications through the interaction of ATC's disclosed herein at distribution substations and the use of ACC's disclosed in referenced U.S. Pat. No. 5,541,498 on distribution lines supplied by the substation. The following describes the further inventive methods by which ATC's provide the transformer voltage bias and includes the switching by the ATC's of additional capacitor banks located on the low voltage output of LTC transformers at distribution substations. The ATC's also provide coordinated control of tapswitches and capacitor banks at transmission substations. The substation capacitor banks may consist of several individually switched sections of power factor correcting capacitors. INFLUENCING LINE CAPACITOR SWITCHING TO CONTROL STATION VARS Please refer again to FIG. 1 showing a single distribution line capacitor bank having control 139 and an LTC transformer having ATC 62. FIG. 1 is useful in illustrating the use of a voltage bias in ATC 62 as influenced by the VAr flow out of transformer 150 as measured by ATC 62.

Figure 16:
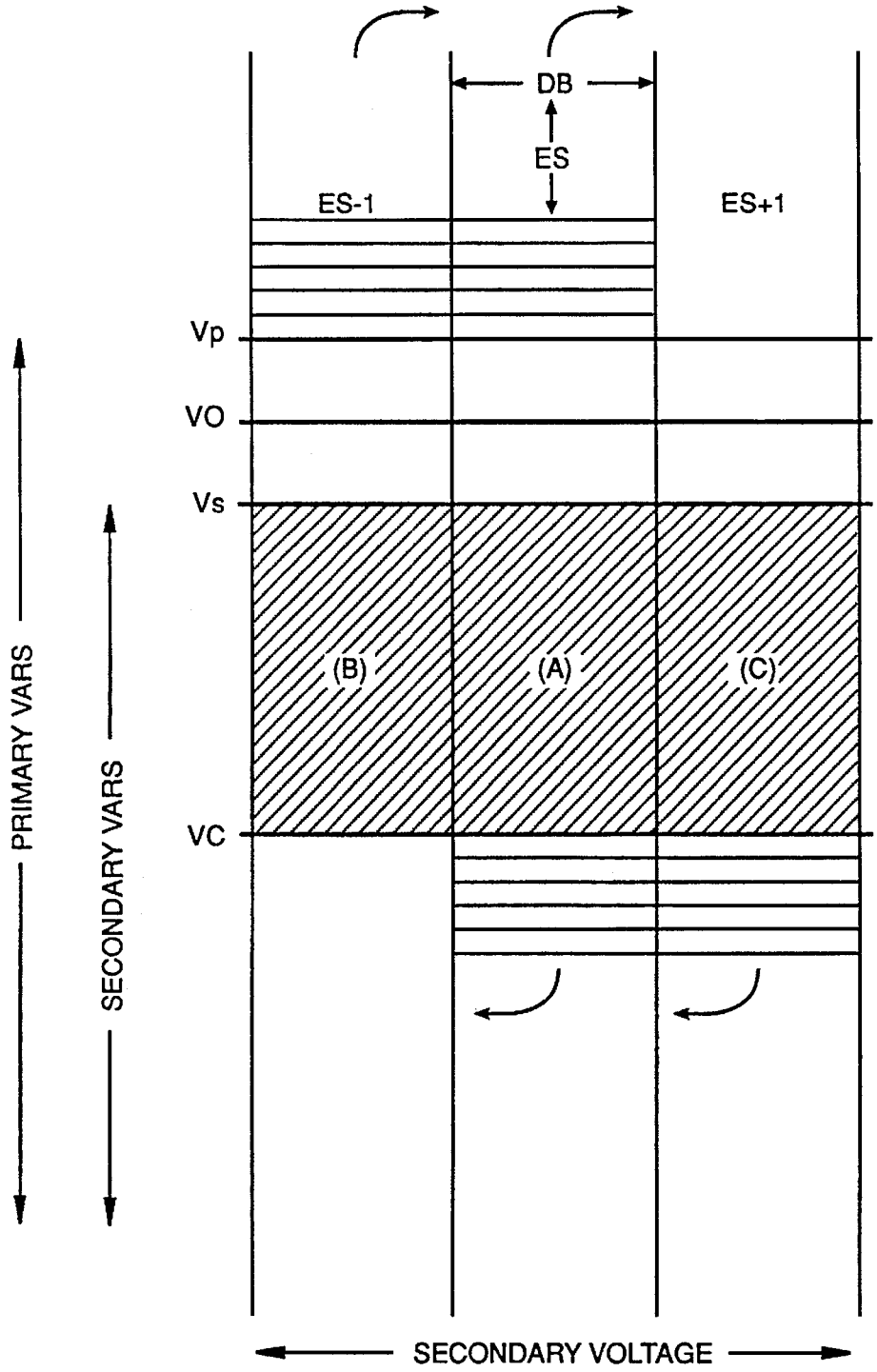
FIG. 16 is a diagram useful in describing the inventive VAr management system wherein the substation voltage influences the switching of distribution circuit ACC's.

FIG. 16 has a horizontal axis of transformer 100 secondary voltages on which ATC 62 voltage setpoints are shown. The initial ATC voltage control band center is ES as shown in FIG. 16 and having a band width DB along the horizontal voltage axis. Assume deadband DB is fixed at one volt AC. The vertical axis is the capacitive VAr flow measured as either going into transformers 100 secondaries 107 (above line Vs) or leaving the transformers 100 primary 101 (above line Vp). The VAr flow is a function of the automatic connection and disconnection of capacitors 119 by switches 120 (FIG. 1) as controlled by ACC's 139.

Transformer 100 secondary voltages are used as first VAr references VS and transformer 107 primary voltages used as second VAr references VP. VAr reference V0 is the average of VP and VS is used in determining actions by ATC's to switch capacitors so as to control VAr flows through transformers 100.

Voltage ES is the initial ATC's 62 voltage setpoint. This setpoint moves automatically down to voltage ES−1 and up to voltage ES+1 to effect switching of distribution capacitors 119 as described in greater detail hereinunder. The deadband around any setpoint voltage position is DB and is assumed to be one volt hereinunder. This must be set higher when using LTC transformers with greater than one volt maximum change per step of the tapswitch.

Deadband area A of FIG. 16 is bound by DB in width, and vertically on the bottom by the size of the largest switchable distribution line capacitor 119 in VArs plotted downward from VO. Areas below VO also represents lagging VArs flowing out of transformer 107 secondaries. When the measured VArs leaves area A at the bottom (with an adaptive time delay), open capacitors 119 (if any), located at some point on the distribution system having the lowest voltage, switch CLOSED after an adaptive time delay in the ACC controlling such switching, improving the VAr flow by the actual VArs produced by the switching. As the voltage along the distribution lines decreases further, more capacitors 119 switch CLOSED. This has the effect of improving the voltage regulation at the capacitor locations and reducing the VAr flow through the transformer. When the distribution circuit load builds up faster than capacitors 119 close, the VAr load may extend below line VC. The area below line VC is divided into quanta ▲Z of VArs (convenient to integer math) preferably by approximately ⅛ of the VAr deadband from VO to VC (equal to the size of the largest distribution line capacitor). A sum Z is formed of $\Delta Z^2$'s. When this sum Z exceeds Z', an adaptive time out limit as explained below, the ATC 62 automatically changes the voltage setpoint downward by DB herein assumed to be one volt, to ES−1 entering area B. Z' adapts to a value that produces a desired daily average number of transitions between areas A, B and C. Generally one expects one transition to area B in the morning and one to area C in the evening. Weather and other conditions may change this from day to day, however. Therefore Z' is varied, say 10% each day, in the direction to bring a weekly average of daily transitions to a desired setpoint. The adaptive daily adjustment is very similar to the adaption of H' to obtain either a desired VRQF or selectively to obtain a desired daily number of tapchange operations.

The sum Z is reset to zero when the measured VArs go above line VC. and also after each change of the voltage setpoint in going between areas A, B and C.

The previously described adaptive features of the voltage control will then operate tapswitches 104 to bring the voltage within area B. Operation remains in area B until the measured VArs move above line VC for an adaptive period. The area above VO is also divided into quanta ▲Z computed as described above. A sum Z is formed of $\Delta Z^2$'s. When this sum Z exceeds Z', the ATC 62 automatically changes the voltage setpoint upward by DB herein assumed to be one volt, to ES reentering area A. In a similar way, when the measured VArs go above line VO from area A the voltage setpoint increases to ES+1 entering area C.

The adaptive features of the ATC's then operate tapswitches 104 (see FIGS. 1 and 2) to maintain the voltage within the voltage range of area C. The higher voltage influences distribution line capacitors controlled with ACC's to switch OFF bringing the VAts measured by the ATC's to fall below VO. Operation remains in area C until the measured VArs move below line VC where again the sum Z of $\Delta Z^2$'s is formed and compared to Z'. When Z' is exceeded the operation returns to area A completing a loop of control action. A curved arrow below area C indicates the transition that occurs as area C expands downward; that is, the operation goes from area C to area A. The sum Z is reset zero when the change is made to allow time for the tapchanging operation to seek the voltage ES at the center of band A. An arrow below area A indicates similar move to area B. Arrows above area B show the transition to area A and above area A show the transition to area C. Note that operation does not change above area C or below area B but waits until time of day and other external factors bring the VArs within the control range.

A history of operation in area B is kept. Long periods in area B during peak load times is an indication that all available capacitors are switched CLOSED and there is a need for additional distribution line capacitors.

COORDINATED CONTROL OF TAPSWITCHES AND SUBSTATION CAPACITORS

Substations using LTC transformers to control output circuit voltage sometimes have power factor control capacitors switchable to the voltage controlled secondary outputs. Present practice is to control the switching of these capacitors with controls independent of the LTC voltage control and the distribution line power factor capacitors. This is generally unsatisfactory because of the interaction of capacitor switching on voltage control. The present invention extends the ATC control of the LTC transformers voltages and interactive control of distribution line capacitors described hereinabove to further include the switching of the substation capacitors.

At transmission stations having secondary capacitor banks on the output of LTC transformers it is desirable to control both the tapswitches to regulate voltage and the switching of capacitors to control the VAr flow through the transformers in order to avoid the improper action that can result from the use of separate tapswitch and capacitor controls.

The control operation described in this section is also used at distribution substations having no lines feeding switched line capacitors.

FIG. 17 in relation to FIG. 2 illustrates the inventive method of switching station capacitors 169 ON and OFF using ATC's 62. The VArs flowing through LTC transformers 100 controlled by the ATC'c 62 is measured by the ATC's 62 and forms the vertical scale of FIG. 17. The left hand portion of FIG. 17, marked 'SECONDARY VOLTAGE', shows the VArs as measured by the ATC's 62. The range in VArs from +VE to −VE is equal to the size of one section of the station capacitors 169 and is measured each time the capacitor 169 switches as the changes in VArs from just before the switching to just after the switching.

The portion marked 'TRANSFORMER LOSS DUE TO VARS' indicates the variation in transformer losses with flow of VArs. Since no VArs flow at point VO, the VAr loss at that point is zero. The capacitors are switched CLOSED and OPEN using ATC 62 outputs C(Close) and O(Open) respectively to sequencer 161 at the points indicated. As the requirement for VArs changes either up or down, the operation points as measured by the ATC's 62 move up and down between the points on FIG. 17 marked CLOSED and OPEN. The choice of the points equally spaced about point VO produces the lowest average transformer 100 loss over a period of time as limited by the size of the capacitor 169 sections. Other capacitor 169 switching points may be required by system operating conditions but are expected to produce greater transformer losses.

As explained hereinabove under the discussion of FIG. 2, capacitors 169 may have several sections as sequentially connected and disconnected by state of the art control 161. The inventive process illustrated by FIG. 17 adds sections of capacitors 169 until all are CLOSED as preferably is indicated by a closed contact 165 input FC to ATC 62. Similarly sections of capacitor 169 are OPENED until all are open as preferably indicated by a closed contact 164 input FO to ATC 62.

The areas above −VE and below +VE are adaptively used to prevent hunting due to smaller changes in measured VArs during a general trend in VAt flow requiring capacitor switching. Measured VArs, when within the areas, are integrated to a value adapted to produce a selected weekly rate of capacitor switching and the integrals reset when the measured VArs pass into the deadbands established between VE and −VE. When the VArs measured by the ATC's move out of the deadband the capacitors are switched CLOSED and OPEN as indicated by FIG. 17.

The areas above and below the deadband are divided into quanta ▲Z of VArs convenient to integer math preferably equal to ⅛ of the VAr deadband. A sum Z is formed of $\Delta Z^2$'s. When this sum Z exceeds Z', the ATC 62 switches the capacitors CLOSED or OPEN as appropriate. The limit Z' is automatically adjusted daily by the ATC's so as to produce a desired weekly average number of capacitor switch operations.

The ATC tapswitch operation adapts as it does where capacitor switching is not used as described above in relation to FIGS. 14 and 15. The non-linear timing brings the voltage change resulting from the capacitor switching quickly back one step towards the setpoint and more slowly back each succeeding step required. In other words, the ATC tapswitch operation responds to the voltage change caused by capacitor switching in the same way as to any other voltage change and adaptively changes the speed of response so as to hold down the tapswitch operations required yet maintain a desired quality of VRQF. Prior art capacitor controls switch on small changes in voltage and therefore are prone to switch incorrectly as a result of the tapchange control operation. The VArs sensed by the ATC for capacitor control are much less effected by the small regulated changes in voltage by the ATC's. Furthermore, the nonlinear timing of the ATC's adapt to eliminating extraneous capacitor switching operations.

COMBINING TAPCHANGER CONTROL, STATION AND LINE CAPACITOR SWITCHING

FIG. 18 is similar to FIG. 16 but adds substation capacitors 169 switched by switches 160 as shown in FIG. 2. The switches are opened by device 161 by outputs O of ATC 62 and closed by device 161 operated by output C of ATC's 62.

Note that capacitors 169 may be a single section as shown in which case devices 161 merely opens and closes switches 160 as directed by output contacts O and C. Alternatively capacitors 169 may have more than one section in which case devices 161 will have the required external logic not shown for switching capacitor 169 sections CLOSED and OPEN in sequence. Several types of switches 161 and means for sequencing are in general use. The contact 0 and C action required to effect the sequencing of section of capacitors CLOSED and OPEN is well known and will not be described in greater detail herein.

FIG. 18 is similar to FIG. 16 but adds the VAr limit VE placed below VO by a value set into the control as equal to a multiple M (generally 0.5) of the size of one section of a capacitor 169 located at the substation along with transformer 100 and switchable by switches 160 to the transformer 100 secondary.

The portion marked 'TRANSFORMER LOSS DUE TO VARS' indicates the variation in transformer loss with flow of VArs. Since no VArs flow at point VO, the VAr loss at that point is zero. The capacitors 169 are switched CLOSED and OPEN at the points indicated. As the requirement for VArs changes either up or down, the operation points as measured by the ATC's move up and down between the points marked CLOSED and OPEN. The choice of the points equally spaced about point VO produces the lowest average transformer loss over a period of time as limited by the size of the capacitor 169 sections. Other capacitor switching points may be required by system operating conditions as obtained using selected values for multiplier M, values other than M=0.5 are expected to produce greater transformer losses.

The existence of the substation bank implies that there are insufficient distribution line capacitors 119 to compensate for all distribution circuit load generated VaAs. Therefore after operation in area B no longer holds the VArs above limit VD, it is assumed that all line capacitors 119 have switched on. That being the case, as the VAr load grows, area B extends downward to limit VE. The substation capacitor 169 is then switched CLOSED and OPEN as described above as described in the section titled "COORDINATED CONTROL OF TAPSWITCHES AND SUBSTATION CAPACITORS".

It can be assumed that the interaction of the added substation capacitor 169 with the series impedance of transformer 100 will increase the transformer 100 secondary voltage. Therefore it is expected that the inventive adaptive tapswitch operation will soon operate the tap switch 104, if necessary, to return operation to region B. The resulting VArs are expected to be above VO by about one half the rating of the switched capacitor 169. Note that the previous switching on of all available distribution line capacitors 119 plus capacitor 169 indicates a heavy load condition. It is very unlikely, therefore that any of the VArs fed out of the primary will reach a generator where an unstable condition could result. Operation within area A with increasing load can be expected, in time, to fall below limit VD thus switching the setpoint to ES−1 as before. With further increased load, VArs falling below VE will again produce an outputs of contacts C adding a sections of capacitor 169. This process cycle between areas A and B until all sections of capacitors 169 are connected if the increase in VAr load so requires.

As the load decreases the operating point moves above −VE and after an adaptive time contacts O will operate so as to remove one section of capacitor bank 169 at a time. When all the sections are removed operation is transferred to area A by changing the voltage setpoint back to ES.

Note that operation remains in the lower voltage region B so long as any sections of substation capacitor 169 are connected. This maximizes the number of distribution line capacitors 119 that remain closed. In fact, the voltage may be lowered even further in response to transformer loading as described hereinabove. This further assures that all distribution line capacitors 119 remain closed to correct power factors and to prevent distribution line load locations having less than minimal required voltages.

Assume the load decreases towards evening resulting with removal of all of capacitors 169. Operation then continues in area A throughout the night, using area C as required to assure removal of distribution capacitors 119 by operation of ACC's. Note that present practice often uses a single fixed distribution capacitor to compensate the inductive exciting current of distribution circuit step down transformers. Use of the inventive methods described herein, permits use of all switched distribution line capacitors permitting the bank having the lowest voltage to stay on at night for user step-down transformer exciting current compensation and helps prevent excessive voltages that can occur during light loading conditions where fixed distribution line capacitors might have been used. The point where a capacitor can cause excessive voltage may move from time to time as determined by nighttime loads and possible switching changes in the distribution circuit configuration. With all capacitors switched by ACC's, this movement is of no concern.

Note that the above first scheme has the disadvantage that the control of VArs occurs during the daily peak load. An alternate second scheme is to switch the substation capacitors 169 on first and off last. This has the disadvantage of having the coarsest VAr control all of the time, even on days when, say only one section of the substation bank is needed.

The preferred scheme described in detail hereinabove has the advantage of leaving the ACC's available during the day to produce the best customer voltage profile and the least distribution power losses.

TYPICAL APPLICATIONS

FIGS. 19 and 20 compare the restricted VAr flow resulting from use of a load tapchanging transformer at a substation and ACC's along distribution lines fed by the transformer as described in FIG. 1 and the further restricted VAr flow resulting from the use of load tapchanging regulators on each phase of a distribution line having ACC's and fed by regulators as shown in FIG. 3.

In FIG. 19 transmission line 151 feeds load tapchanging transformer 100 which then feeds three distribution lines 152. Each distribution line has three midway load tapchanging regulators 150, only one of which is shown. Many inductive loads 148 are shown along the distribution lines. Three capacitor banks 119 are shown on each line 152 between the transformer 100 and regulators 150 and three more capacitor banks between each of three regulators 150 and the ends of the lines. Note that although one regulator 150 is shown midway in each of three lines 5, actually three are used in each location, one on each phase of lines 152. Each of the resulting nine regulators is equipped with an inventive control 62, only one being shown at each of the three regulator locations. Arrows 153 illustrate flow of inductive VArs from loads 148 into capacitors 119 for correction. Note that while no VAr current flows through regulators 150 due to the VAr control features of associated controls 62, VAr current does flow through the common distribution circuit 152 connecting transformer 100 to the three radial distribution lines.

Note that the capacitors numbered 119 in FIG. 19 are actually banks of three; one for each phase with only one being shown due to the nature of the single line representation used. FIG. 19, therefore does not indicate which phase the controls are connected to. For circuits fed by a three phase load tapchanging transformer 100 as in FIG. 19, it is preferred that all capacitor controls 139 be connected to the same phase as ATC 62 so that any unbalance in phase voltage will not interfere with the inventive relation of the VAr bias from transformer 100 to the voltage sensed by ACC's 139.

FIG. 20 shows, in full three phase form, one of many radial lines at a distribution station fed from transmission lines 151 through fixed ratio step down transformers 149 and regulators 150 using inventive controls 62, to each of three phases of the line 152. Line 152 has a midway regulator 150 bank of three regulators, one in each phase and each having an inventive control 62. VAr flow lines 153 show load VArs flowing to the nearest capacitor 119 and not through regulators 150 due to the use of VAr bias techniques in each ATC 62 and the resultant response of ACC's 139. Note that no VAr flow is permitted (within the discrete nature of the banks 119) from lines 152 and similar lines supplied by transmission lines 151 within the same substation as was possible in the system described by FIG. 19 above. Note that in practice, however, controls 139 on one phase may drive capacitor switches switching all three phases even though control 139 senses only one phase.

For circuits having each phase regulated by an individual load tapchanging regulator as in FIG. 20, however, it is preferable that the controls be rotated between phases in a progression of capacitor locations as further shown in FIG. 20 so that each regulator 150 ATC 62 will directly effect at least one capacitor bank. If there are less than three capacitor banks, then the VAr bias is only used on the regulator ATC 62 matching the placement of a capacitor control 139 phase connections.

AUTOMATIC POWER REVERSAL OF LINE REGULATORS

The possible values of P range from a positive maximum to a negative maximum. Negative values indicate a reversal of power flow and is useful in reversing the operation of ATC's 62 should there be a reversal of power flow as sometimes occurs when regulators are used at midpoints of distribution lines alternatively fed from either of two points.

Reference U.S. patent application Ser. No. 152,001 describes a control useable with single phase regulators installed at a midpoint on distribution lines as illustrated in FIG. 18. The reference patent describes keeping track of the regulator tap positions and using a mathematical model of the regulator together with measured levels of regulator lead currents, computing voltages on what is normally the unregulated input of the regulators. The patent describes a method of determining a reversal of power flow requiring a change in the control action. In the reverse condition it is necessary to reverse the raise and lower tap response to measured voltage. The line drop compensation action is also reversed so that it is functional in the new direction of power flow.

In this invention, the direct measurement of P forms the basis of initiating the required control action upon detection of power reversal. This involves two factors. Since P is measured 20 times per second (for a 60 Hz frequency), the first factor is to average P using a recursive equation of sufficient time constant to reduce any fast jitter of the measured values of P. The second factor is to establish a small deadband either side of P=0, where the sign of P changes indicating a reversal of power. This inventive use of the direct measure of power flow, P is used in place of the method disclosed in U.S. Pat. No. 5,581,173.

The inventive determination of P provides an order of magnitude improvement in resolution of power reversal as compared to prior art methods using 16 samples per cycle of AC waves.

Note that the internal impedances of regulators is much smaller than for LTC transformers. For that reason the variables VP, VO and VS as used in determining VAr control as described in reference to FIG. 16 may reasonably be assumed equal to each other. The measurement of VArs related to the normal direction of power flow through regulators therefore need not be reversed upon reversal of power flow through the regulators.

Since the ATC does not normally use line drop compensation but preferably uses the inventive changing of the regulated output voltage to influence the operation of ACC's, this operation is reversed so as always to influence ACC's on the power output side of the regulators.

Often it is adequate in practice for a control to block a tapchanger upon change in direction of power flow. This avoids hunting of the control since the control action changes from degenerative to regenerative upon power reversal. This blocking action is easily accomplished in the ATC by a simple sub program responsive to the change in polarity of P.

CONTROL OF WATTS LOAD ON DISTRIBUTION TRANSFORMERS

When a power system becomes overloaded, it has been found that the load can temporarily be lowered by reducing the voltage to the users of electric power. Since many appliances, such as air conditioners, may operate less efficiently at reduced voltage, the benefit of reduced voltage may only last for a few hours; enough to relieve a load peak caused by a weather condition. Once the load peak has passed, it is desirable to bring the voltage back to normal.

Furthermore, when load conditions permit it is desirable to raise the voltage. The increase in voltage may benefit users of electricity in operating appliances whose efficiency increases for a small increase in voltage. The increase in voltage also produces added revenue to the electric utility. A carefully controlled increase held within the ±5% range generally permitted by most state statutes is generally desirable under permissive conditions.

An inventive strategy is to set the ATC operating setpoint at, say 124.5 VAC. At this level the combination of the ATC operation disclosed herein together with the action of ACC's used to switch distribution circuit capacitor banks holds the voltage along the distribution lines just below the upper 5% limit of 126 VAC required by most state statutes. In greater detail, the voltage regulation quality factor, VRQF, is defined herein and can be set into the ATC for a value of error voltage which when added to the setpoint voltage of 124.5 VAC suggested above will not exceed 126 VAC. For much of the year, especially in the spring and the fall when heating and air conditioning loads are low, these voltages can be maintained without exceeding generator or distribution transformer capabilities.

Under conditions of heavier load it is desirable for ATC's to automatically bring down the substation output voltage in small steps at individual distribution transformers to prevent their overload whether or not a total system overload load condition exists which could possibly lead to a voltage collapse power outage. This automation of voltage reduction made possible by the present invention starts taking effect as a load increases in anticipation of a possible system overload. The cumulative effect of individual transformer adaption may correct a system overload condition avoiding or at least delaying use of the present practice of reducing the voltage at all substations as an emergency correction whether or not all individual distribution substation transformers are overloaded.

Individual transformer ATC's 62 sense, say, a load equal to the nameplate rating of a transformer and decrease the setpoint voltage by a selected amount such as one volt. With further overload to, say 110% of rating in spite of the first reduction, the ATC's 62 decreases the voltage an additional amount. Additional reductions to a lower limit, say 115.5 VAC are automatically put into effect as the load increases indicates. Since the number of points of reduction in the inventive ATC's 62 is but a matter of the microprocessor program, no cost is created by the fineness of voltage reduction in response to transformer overload. Prior art controls are limited by overall cost to one, two or three steps of reduction because of the additional hardware required.

The ACC's cooperate by closing capacitor switches when the voltage reduction occurs. This improves the power factor as is generally required during an overload condition. When so switched on, power factor correction capacitors also tend to hold the voltage above the lower 114 VAC limit required by most state statutes at distribution circuit locations far from substations.

As the peak load decreases, generally in the afternoon and evening, the substation voltage is automatically increased until it is back to the original setpoint level.

FIG. 21 shows a nominal 120 VAC setpoint with ±5% (±6 volts) range permitted to the electric utilities by most state statutes. Note that in FIGS. 16 and 18, operation utilizes a three volt band. FIG. 21 shows 10 such bands with the centers marked 1 through 10 in one volt steps starting with step 1 at 124.5 volts and ending with step 10 at 115.5 volts. The inventive control determines the temperature of the transformer and lowers the operating voltage center point from step 1 down to step 10 as required to reduce transformer over-temperatures. As the transformer goes below a set temperature, the operation moves back to position 1 thus minimizing variations in loading of the electric power system.

With the lack of this automatic system, the reaction to overloading is often delayed until a system wide emergency lowering of voltage is initiated. This is often too late and power interruptions result.

Preferably the transformer temperature is measured directly and fed into the LTC control as an electrical analog or digital signal. When such measurement is not available, the LTC control measures P. This Watts reading P is integrated using a thermal model of the transformer and the transformer temperature estimated. A measure of ambient temperature is required which is self contained within the control which then is preferably mounted outdoors with the transformer.

ADDING A FACTOR PROPORTIONAL TO THE SQUARE OF LOAD CURRENT

Transformer load current flowing through tapswitch contacts causes deterioration to the contacts generally believed to vary as the square of the current flowing when a tapchange is made. It is desirable, therefore, to make ATC's 62 respond more slowly to voltage deviations when the load currents are high and faster when the load currents are low. It is also desirable to block the tapswitch operation entirely for load currents above some limit $I_{max}$. This preferably is set just above a short term overload rating of the transformer; typically 120% of the "transformer nameplate rating".

FIG. 22 illustrates an inventive method of accomplishing these current related factors using the following steps:

a) Increment and decrement timing interval H as described in greater detail in relation to FIGS. 14 and 15.

b) Before comparing H to H' multiply H by:

$$i=(1-(I/I_{max})^2)) \quad 3)$$

c) If the new value of H is greater than H', then initiate a tapchange.

FIG. 22 shows how the time required to correct a voltage error varies as a function of transformer load current. Note that at load of 50% of $I_{max}$, the factor is one, assuming 50% as a weekly average load about which the limit H' will adapt. At no load, the response time to voltage variations decreases to 75% of the time at 50% load. At a load of 80% of $I_{max}$, the response time to voltage variations increases by a factor of 4. At $I_{max}$ the value of the H multiplier (equation 3 above) becomes zero and currents at this value and above will block the tapswitch operation. Currents over $I_{max}$ indicate a system fault or a serious abnormality at which time the loss of a transformer tapswitch would greatly compound an already difficult condition. Blocking the tapswitch operation is therefore acceptable at overload currents. In contrast to the present invention, prior art systems generally use an overcurrent relay which has no effect until the pickup value of current is exceeded.

Computations are performed just following the measurement cycle. When computations are complete, communications is performed if a request has been received or if the program within ATC 62 calls for a communication outward. Communications is preferably done at high bit rates with a single packet of data.

COMMUNICATIONS

FIG. 23 is an isometric view of the inventive ATC's 62 illustrating the use of palm top and lap top computers 903 as the man-machine interface (MMI). In addition to eliminating all but a few infra-red diodes 904 for indication of ATC operation, these man-machine interfaces selectively uses two way infra-red ports available on palm top and lap top computers. These are matched with two way infra-red port 901 on ATC's 62.

Alternatively communications is provided by way of a plug in wireless modem 902 using PCMCIA receptacle 900. This is discussed further hereinbelow in the discussion of the use of Internet.

A third alternative is the use of an adapter responsive to well known selected SCADA protocols.

RECORD KEEPING

Use is made of the computing power of external computers using one or more of the alternative communications means to replace ATC programming wherever possible, thereby further reducing the size of the ATC programs.

While the adaptive features of the ATC virtually eliminates the need for communicating to the ATC, the inventive LTC control is capable of generating vast amounts of data, often far beyond the amount capable of human examination and use. The data is most useful, however in analyzing a system disturbance such as a voltage collapse event often resulting in loss of service to parts of an electric power network. An inventive system is described hereinunder in which data may be held in the LTC control until requested.

Data is recorded in memory of the LTC control at many equally spaced intervals RT during a day, the intervals preferably being one to four minutes. Preferably the data includes:

File A. Averages EMA of AC voltage measurements EM calculated over periods equal to intervals RT. Preferably the average EMA is obtained from a recursive equation:

$$EMA'=((NM-1)*EMA)+EM)/NM \quad 4)$$

where EMA' is the new average voltage after obtaining measurement EM and EMA is the average before obtaining measurement EM, and where NM is the number of measurements in time period RT.

Note that external computers receiving files of EMA data may compute Voltage regulation quality factors VRQF over intervals RT by:

$$VRQF=((\Sigma(EM-ES)_2)/NM)^{1/2} \quad 5)$$

where ES is the voltage setpoint.

File B. Average measured Watts WMA over time period RT preferably using equation 6).

$$WMA'=((NM-1)*WMA)+EM)/NM \quad 6)$$

File C. Average measured VArs VMA over time period RT preferably using equation 7).

$$VMA'=((NM-1)*VMA)+EM)/NM \quad 7)$$

Preferably this data is recorded in non-volatile memory in blocks of a single day's data. Preferably the day starts and ends at midnight with the day's date entered at the start of each day's block.

Blocks of data are saved for selected numbers of days. The process is described hereinbelow illustrating the use of eight blocks for one week of data.

The blocks are identified for purposes of illustration as follows:

| | |
|---|---|
| Block 0: | today's data from midnight to time of request for the data. |
| Block 1: | yesterdays data. |
| . | |
| . | |
| . | |
| Block 7: | data for a week ago today. |

At midnight block 7 is erased and re-identified as block 0 with other blocks moved up by adding one to the old number.

This data is accessed upon demand using the IR port with a computer having an IR port, by use of the wireless modem as described hereinbelow and by use of a SCADA interface device.

A selectively alternate or additional recording is to record fine grain voltage, Watts (P) and VAr (Q) quantities with integrating time periods in the order of one second and for periods in the order of, say 15 minutes. This data is particularly useful in substantiating reasons for the previously mentioned voltage collapse failure of electric power service. There is an unsubstantiated theory that such failures may result from the cascading of induction motors stalling due to low voltages. As is well known, fully loaded inductions motors will stop turning at voltages typically 70% of rated voltage. A stalled motor will draw heavy lagging current further contributing to lower voltages along a power distribution line. Thus one motor towards the far end of a line may cause an adjacent motor to stall, and so on. Many motors may remain stalled for several seconds until overtemperature relays remove their power source. The protection is sufficiently slow that a domino effect of motor stalling may overload a distribution line branch until a fuse blows. Wide spread repetition of this effect may theoretically contribute to a voltage collapse interruption of power over a wide range. No data has been reported to the industry, however to either prove or disprove this theory. The inventive recording of the data as described here may provide understanding for the correction of voltage collapses caused by motor stalling.

This fine grain data recording is best done using timing intervals convenient to the microprocessor programs and to the use of the microprocessor memory. Integrating times need not be precisely one second and is varied to best pack the data into blocks of memory as required for the type of the memory chosen. Such data packing also contributes to the communicating of the data in serial digital strings compressed with little or no wasted space.

Preferably the fine grain data is stored in flash or other non volatile memory so as to be available after a power interruption that may follow a particular pattern of variation of voltage and P and Q components of power flow. In addition the length of time before the fine grain data is overwritten is a function of the efficiency in the use of the memory and the amount of memory available. Preferably this data is communicated automatically, using one of the ways described above, following a power interruption of greater than a selected time. This automatic communications prevents useful data from being overwritten as the power returns to normal.

COMMUNICATING DATA TO THE INTERNET

The data is entered into Internet via a wireless modem where it is then available to computer users at many locations in the effected network desirable of analyzing the system disturbance so as to minimize effects of a reoccurrence of the disturbance.

The digital data is sent from the LTC ATC 62 via wireless modem 902 (see FIG. 23) using radio signals between the ATC 62 and regional radio towers capable of sending and receiving digital signals over a radius of some 20 miles. From the regional digital signals are exchanged with a central digital signal dispatching station capable of entering data into Internet as messages accessible to users of Internet.

Modems 902 available for the radio signaling include a Motorola 100 D device. These plug into PCMCIA receptacle 900 in the LTC ATC 62 using parallel interfaces with the microprocessor 1 (see FIG. 5).

Alternatively Motorola Envoy devices not shown are used for the radio signaling devices using a serial interface with the control 62.

The regional means and the central dispatching station are typically provided by an Ardis Communications Network in turn using a Radiomail interface with the Internet.

A master user of Internet may request all blocks; any one block; and any file A through D as described hereinabove. This master user determines the communications costs in the selection of data to be transferred. Once transferred, other users of Internet can use the data with more minimal Internet charges.

ADAPTIVE TAPCHANGER CONTROL TEST SETUP

Adaptive capacitor control (ACC) production equipment that is patterned along the lines of the invention disclosed in U.S. Pat. No. 5,541,498 has been successfully tested on Florida Power Corporation distribution lines.

A test setup was installed which included controls connected to 120 volt outlets at locations served by Florida Power Corporation distribution lines. These controls sensed, and responded to, the voltage variations created by Florida Power customers as they turned room thermostats up and down, as air conditioning equipment responded to daily and seasonal fluctuations in temperature. It was found, for example, that whether or not the sun was shining was a major factor on the voltage and in turn in the operation of the adaptive capacitor controls. The test setup involved the varying of scaling factors and other details of the non-linear adaptive process so as to properly respond to the very complex behavior of many persons living and working in the area served by the distribution lines from which the controls received their power.

Adaptive tapswitch controls were combined with the inventive technology disclosed herein, and the following additional tests were carried out using the utility customer generated voltage variations on a Florida Power Corporation distribution line.

A 120/240 volt service was connected to the test setup from a 25 KVA transformer on a 13 kv circuit service. This service was free from loads other than the test connections to be described. In this way the test setup responded to the fluctuations in the 13 kv distribution voltage virtually independently of the load on the service transformer since the test equipment load was kept very small and nearly nonvariant.

FIG. 25 shows this service and FIG. 24 shows in the test setup to measure the improvement resulting from the inventive adaptive LTC control described herein.

In FIG. 25 transformer 201 steps down the nominal 7,500 VAC of the 13 Kv (phase to phase) distribution line 200. This distribution line feeds 3 phase power to a customer through three transformers 204 via conductors 205 to entrance 206. The single phase 120/240 volt service for the test setup work is carried over conductors 202 from transformer 201 to entrance 203.

FIG. 24 shows entrance box 175 for the single phase service feeding voltage via conduit 174 to regulators T1, T2 and T3. This provides for tests with three single phase regulators.

Terminals 176 of the regulators are the neutral terminals, terminals 177 are the unregulated input terminals. In this setup terminals 177 are supplied with unregulated nominal 120 VAC from the experimental supply shown in FIG. 25. Terminals 178 are the regulated output terminals of the regulators.

Regulator T1 is controlled by tapchanger control 180 which comprises a Beckwith Electric Co. M-0067 control as described in U.S. Pat. No. 3,721,894. Control 180 senses the regulated 120 VAC directly from terminal 178 rather than from a step-down transformer normally used. Control 180 is set at 120 VAC with a two volt bandwidth, 120 second time delay using the standard timer and non-sequential operation. In this way, the timer resets after each tap change, integrates upward when the voltage is out of band and resets when the voltage is in band.

Regulator T2 is controlled by tapchanger control 171; a Beckwith Electric Co. M-2001 control which is described U.S. Pat. No. 5,581,173. Control 171 senses the regulated 120 VAC directly from terminal 178 rather than from a step-down transformer normally used. Control 171 is set at 120 VAC with a two volt bandwidth, 120 second time delay using the integrating timer option and non-sequential operation. In this way, the timer resets after each tap change and integrates upward when the voltage is out of band and downward when the voltage is in band.

Regulator T3 is controlled by the inventive ATC 339 as described herein. Additional ATC's 139 and 239 are connected to regulators T1 and T2 to gather data only. All three controls 139, 239 and 339 measure the voltage each half cycle and compute two recursive averages of VRQF; the first having a short term and a second being a recursive average of the first recursive averages having a long term. In addition, a third recursive average of voltage having a short term is computed. The first and third short term averages are recorded for study of the ATC's behavior.

Equation 5) hereinabove is used in computing the first and third averages VRQF using chosen time constants which are binary numbers providing a time constant of approximately two minutes. Binary numbers are chosen for convenience in dividing by shifting the binary point in the control 139 microprocessor program.

In using equation 5) ▲E is the difference between the measured voltage and the band center voltage, which for all controls in this test is set to 120 VAC. Note that the squaring process produces only positive answers, independent of whether the voltage error is above or below 120 VAC.

The ATC 62 computes the second recursive average providing a one week time constant referred to as the weekly average available for readout using computer 73 whenever requested. In early stages of the tests, H' was adjusted manually so that ATC 339 gave the same weekly average VRQF as the M-2001 control 171. In later stages of the tests H' is adjusted adaptively to produce a VRQF of 0.4, that being the value obtained in the earlier stages.

The binary number 8192 is proper to use in equation 5) in a control which is measuring only voltage. In such a control, using the SLIM technology disclosed in U.S. Pat. No. 5,544,064, every cycle of the AC wave is measured and used in the first equation 1). In a control using both voltage and current in making measurements, computations such as of equation 1) are made every three cycles giving 20 measurements per second; 1,200 per minute and 2400 in two minutes. The binary number, 2048, is then used in place of 8192 in equation 5). Note that in the SLIM technology, the samples of the AC waves is synchronous with the ADC for greatest efficiency of the sampling process, the computation and communications period is accomplished within one half cycle so as to make the packets of measurement, computation and communications synchronous with the AC frequency. The counting of AC cycles then becomes the primary method of measuring times such as the two minutes and one week chosen for the short and long term recursive averages.

Adaptive controls 139, 239 and 339 located on regulators T1, T2 and T3 compute the same recursive averages of the voltage error squared and communicates these to computer 73 where the short term average is available as a time plot and the long term average available as a number. Note that the measurement of VRQF for all three regulators T1, T2 and T3 are obtained using identical ATC 139, 239 and 339 hardware and programs and identical computer 73 processing of data so as to fairly compare the rates of tapchanges of the three regulators.

Controls 139, 239 and 339 have set deadbands of 1.0 VAC and set voltage limits 6 VAC above and below the band center voltage (herein 120 VAC). When the voltage is above the deadband DB of FIG. 15, "H" times upward nonlinearly and when the voltage is in the deadband DB, "H" times downward at a selected rate. This adjustment of "H" occurs after each synchronous measurement interval until either:

a) "H'" is exceeded in which case the tapswitch is moved down, (T3 only) or b) the voltage moves below the deadband DB in which case "H" is reset to zero.

When the voltage is below the deadband DB, "H" times upward nonlinearly and when the voltage is in the band, "H" times downward at a selected rate. This adjustment of "H" occurs after each synchronous measurement interval until either:

a) "H'" is exceeded in which case the tapswitch is moved up (T3 only) or b) the voltage moves above the band in which case "H" is reset to zero.

The non-linear process substantially identical to the one disclosed in U.S. Pat. No. 5,541,498. While the present invention discloses the fundamental concepts for making "H'" adapt to a desirable value, the test setup provided data to refine the detailed adaption algorithms for "H'", therefore in earlier stages of the test "H'" was adjusted manually.

The VRQF is obtained using computer 73 and H' changed daily in ATC 339 on regulator T3 until the measures of voltage quality from regulators R1 and R2 is equal to the voltage quality from regulator R3. Note that the voltage quality from regulators R1 and R2 was found to be nearly equal with the settings chosen for them as described above.

Operations of regulator R1 by the M-0067 control and regulator R2 by the M-2001 control were found to produce very nearly the same VRQF. H' was varied in control 339 to match and the daily average number of tapchanges in the three regulators were compared. The rate of operations of regulators T1 and T2 were found to be nearly equal and the rate for regulator T3 was found to be approximately 40% less when a value of H' was found giving the same VRQF in all three regulators.

FIG. 26 shows a 24 hour plot of the regulated voltage produced on Jul. 10, 1996 by a ATC set for a weekly average VRQF of 0.4 volts rms. The time scale is for a 24 hour period starting at midnight.

FIG. 27 shows a 24 hour plot of VRQF's with two minute time constants corresponding to the voltage plot of FIG. 26.

The following table gives additional test results corresponding to the data shown in FIGS. 26 and 27. The weekly average of tapchanges per day is for the week preceding Jul. 10, 1996. Note that H' of the ATC was adjusted manually to bring the weekly average VRQF of the M-2001 and the ATC together. The M-0067 was adjusted for the same bandwidth and timeout setting as the M-2001 with no further effort to balance the VRQF produced by the M-0067.

| CONTROL | WEEKLY AVERAGE VRQF | NUMBER OF TAP-CHANGES DAY OF FIGS. 26 & 27 | WEEKLY AVE TAPCHANGES PER DAY |
|---|---|---|---|
| M-0067 | 0.512 | 27 | 23.0 |
| M-2001 | 0.413 | 26 | 21.7 |
| ATC | 0.408 | 14 | 14.8 |

ADVANTAGES OF THE INVENTION

1. Reduced number of tapchanges required to obtain a desired quality of voltage control.
2. Improved voltage control resolution.
3. Measuring and minimizing VAr flow by voltage bias influence on distribution line ACC switching.
4. Coordinated control of substation capacitor banks and LTC transformer tapswitches.
5. Adaptive algorithms are superior to, cannot be duplicated by human control and eliminate most human control.
6. Provision of selected periods of high resolution data on daily voltage control with any days data callable on demand such as into Internet for wide distribution.
7. Fine grain voltage data collected and following a power interruption held for recall within a selected time for analysis such as following a wide area voltage collapse blackout.
8. Correlating fine grain data with library of voltage templates to determine need to trip load shedding circuit breakers.

While the invention has been particularly shown and described with reference to a preferred embodiment thereof, it will be understood by those skilled in the art that various changes in form and in details may be made therein without departing from the spirit and scope of the invention.

I claim:

1. Adaptive apparatus for controlling voltage tapchanging switches on transformers and regulators in an alternating current (AC) power system comprising in combination:

a) means for taking digital samples of said AC voltages and continuously processing said samples to obtain amplitudes of said AC voltages, b) program means for entering AC voltages as setpoints and for establishing deadbands around said setpoints, c) said program means further including means for determining deviations of said measurements inside and outside of said deadbands and for integrating linear and nonlinear functions of said deviations, and d) output means for raising the position of said tapswitches when said AC voltages are below said deadbands and when said integration exceeds a threshold and for lowering the position of said tapswitches when said AC voltages are above said deadbands and when said integration exceeds said threshold whereby said tapswitches operate to regulate said AC voltages.

2. Apparatus as in claim 1 further comprising in combination:

a) means for determining the quality factor of said voltage regulation, and b) feedback means for changing said thresholds in response to said quality factor determinations to produce a desired quality factor averaged over a selected time period.

3. Apparatus as in claim 1 further:

a) including means for determining the average daily rate of raising and lowering said tapswitches, and b) including feedback means for changing said thresholds in response to said daily rate determinations to produce desired daily rates of tapswitch operations averaged over selected time periods.

4. Apparatus as in claim 2 further including means for determining said quality factor as the square root of the sum of the squares of the average voltage deviations from said voltage setpoints.

5. Apparatus as in claim 4 further including means for using recursive equations for computing said average voltage deviations.

6. Apparatus as in claim 4 further comprising in combination:

a) means for using a first recursive equation having a time constant in the order of minutes, and b) means for using a second recursive equation for averaging results of said first equation; said second equation having a time constant in the order of a selected number of days wherein results of the second equation are fed back to produce the desired daily voltage regulation quality factor.

7. Apparatus as in claim 1 further comprising in combination:

a) analog to digital converter means for making free running digital conversions of said AC voltages, and b) program means for using measurement loops which run synchronously with said conversions thereby reducing the size and increasing the speed of said program means.

8. Apparatus as in claim 1 wherein said program means use integer mathematics thereby reducing the size and increasing the speed of said program means.

9. Apparatus as in claim 1 wherein said program means use no interrupts thereby reducing the size and increasing the speed of said program means.

10. Apparatus as in claim 6 further comprising in combination:

a) means for storing results of said first equation at intervals of selected number of minutes, b) means for identifying said stored results in blocks of one day's results, and c) means for communicating selected numbers of said blocks of data upon request.

11. Apparatus as in claim 6 further comprising in combination:

a) means for storing results of said first equation at intervals of selected numbers of minutes, b) means for identifying abnormal trends in said results of said first equation, and c) means for initiating communication of said data at the time of identifying abnormal trends.

12. Apparatus for the direct measurement of the real, P, and imaginary, Q, components of alternating current (AC) electric power using AC voltage and current signals comprising in combination:

a) microprocessor means including central processors unit (CPU) means, memory means, analog to digital converter (ADC) means, result register means, and analog to digital control logic (ADCTL) means, b) said ADC means providing digital samples of positive half cycles of said AC signals, c) program including means for setting ADCTL means to continuously sample said AC voltage signals and place results in said result register means, d) measurement means operating synchronously with said continuous sampling, e) means for providing values of sine functions from a ring of an integral number of sectors of N values per sector with the total number of values equaling the number of samples expected from one full cycle of said AC signal at an expected power frequency, f) means for multiplying values from said ring over a selected range of 180° of said ring with samples from said result register as they are taken and summing said samples to measure the fundamental frequency component of said AC voltage signals, g) means for setting said ADCTL means for continuous sampling of said AC current and placing results in said result register means, h) means for multiplying values from said ring over a first selected range of 360° of said ring with samples from said result register as said samples are taken and summing said products to measure the P component of said AC power, and j) means for multiplying values from said ring over a second selected 360° range rotated 90° from said first range with samples from said result register as said samples are taken and summing said products to measure the Q component of said AC power.

13. Apparatus as in claim 12 further comprising in combination:

a) means for connecting a second current signal to said ADC means so as to obtain digital samples of positive half cycles of said second current signal, b) means for obtaining second P and Q components using said voltage signals and said second current signals, and c) means for comparing ratios of said first components to ratios of said second components and thereby determining which current led the other in time phase relationship.

14. Adaptive apparatus for controlling voltage tapchanging switches on load tapchanging (LTC) transformers with secondaries paralleled with each transformer control sensing said transformer load current together with load currents of next paralleled transformers in daisy chain arrangement around rings of said paralleled transformers in an alternating current (AC) power system comprising in combination:

a) means for sensing first P and Q components of said transformer load current, b) means for sensing second P and Q components of said next paralleled transformer load current, c) means for controlling said tapswitches so as to maintain ratios of said first P and Q components equal to said second P and Q components whereby losses introduced by paralleling are minimized with or without having transformer primaries in parallel.

15. A system for controlling P and Q components of alternating current (AC) electric power flowing through controlled devices comprising load tapchanging (LTC) transformers and regulators in distribution substations and along distribution power lines extending from said substation comprising in combination:

a) adaptive tapchanger control (ATC) means for operating said controlled devices in response to AC voltage and current signals as measured at outputs of said controlled devices, b) said ATC's including means for changing tapswitch means in said controlled devices to regulate said AC output voltages, c) power factor correction capacitor means connected at selected locations along said distribution lines, d) adaptive capacitor control (ACC) means for switching said capacitor means on and off of said lines in response to AC voltages measured by said ACC means at said selected locations, e) said ATC's further including means for measuring the Q component of said controlled devices' outputs, f) said ATC's further including means for changing said regulated output voltages to influence the switching of said capacitors by said ACC's to provide the desired voltage and VAr conditions with a minimum combined number of operations of said capacitor means and tapswitch means.

16. Apparatus as in claim 15 further comprising in combination:

a) measurement means connected to input LTC transformer temperatures to said ATC means, b) input means for inputting transformer temperature setpoint limits above which load reduction is required, c) means for lowering said regulated voltages to automatically minimize further increases in transformer temperature.

17. Apparatus as in claim 16 further comprising in combination:

a) said ATC's further including means for limiting said lowering of voltage at a voltage setpoint limit, and b) said ATC's further including means for initiating emergency communications when the transformer temperature exceeds said setpoint limits to call for emergency measures to protect said transformer from damage.

18. Apparatus as in claim 16 wherein:

a) said ATC's further include means for limiting said lowering of voltage at a voltage setpoint limit, b) means for interrupting electric power flow to selected users of said power, and c) means for initiating said interruption of electric power whereby more widespread power interruptions may be avoided.

19. Apparatus as in claim 15 further comprising:

a) combined apparatus and program means to keep track of tapswitch position, b) integral ambient temperature measuring means, c) program means for estimating transformer temperatures using P, Q, tap position and ambient temperature information, d) means to input transformer temperature limits above which load reduction is required, and e) means for lowering said controlled voltages to minimize further increases in transformer temperature.

20. Apparatus as in claim 15 further comprising in combination:

a) means for inputting power system requirements for load reduction, b) means for lowering said regulated voltages to contribute to a system requirement for load reduction.

21. Apparatus as in claim 15 further comprising in combination:

a) two way infra red communications port useable for two way communications with standard palm top and lap top computers, and b) said computers including program means providing man/machine functions for said ATC's.

22. Apparatus as in claim 21 further comprising in combination:

a) means for providing raw data to said computers, and b) computer means for extracting information from said raw data and presenting said information for human interpretation.

23. A system for communicating digital data from adaptive tapchanging controls (ATC's) for alternating current (AC) electric power load tapchanging (LTC) transformers and regulators to computers comprising in combination:

a) said ATC's including means for sending said digital data signals and receiving digital signals requesting said data by radio, b) regional stations for two way conversion of said radio digital signals into two way land line digital signals, c) said regional stations including means for sending radio commands to selectively request said digital data from said control means, d) said ATC's further including means for sending said digital data by radio to said regional station means in response to requests for said data, e) a central station for exchanging said land line digital data with more than one said regional station and entering said received digital data into Internet, f) computers selectively requesting said digital data via the Internet and obtaining said requested data from said controls via said regional stations and said central station, and g) said computers further including means to request and utilize said data whereby said control data is accessible from a multiplicity of computers connectable to the Internet.

24. A system as in claim 23 whereby said control further includes means for initiating entry of said digital data as Internet messages.

25. Apparatus as in claim 23 further comprising in combination:

a) means for computing the square root of the sum of the square of the average voltage deviations from a voltage setpoint, b) means for using a recursive equation for obtaining said average voltage deviations, said equation having a time constant in the order of minutes, c) means for storing results of said equation at intervals of selected number of minutes, d) means for identifying said stored results in blocks of one day's results, and e) means for providing selected numbers of said blocks of data upon request.

26. Apparatus as in claim 23 further comprising in combination:

a) means for inputting data modeling voltage collapse events, and b) means for cross correlating voltage measurements with said models so as to determine the occurrence of a voltage collapse event and thereupon initiate a transfer of preselected blocks of data to the Internet.

27. Apparatus for controlling Var flow in electric power systems including alternating current (AC) distribution lines, voltage control transformer means sending output power into said distribution lines, said apparatus comprising in combination:

a) first control means for determining a desired voltage to be sent into said distribution lines, b) power factor correction capacitor means located at spaced intervals along said distribution lines, c) said first control having means for sensing said transformer output voltages and currents and determining the VArs flowing between said transformers and said distribution lines, d) second control means for selectively connecting and disconnecting said capacitor means, collapse, e) said second control means for connecting said capacitor means after a time determined as a non-linear function of the amount the sensed voltage has been below band edge voltages established below average voltages sensed at said capacitor locations, f) said second control means disconnecting said capacitor means after a time determined as a non-linear function of the amount the sensed voltage has been above band edge voltages established above average voltages sensed at said capacitor means locations, g) said first control means causing power to be sent temporarily at lower than said desired voltage to influence said second control means to connect said capacitor means to correct said actual Vars flowing to the desired Vars flowing, and h) said first control means causing power to be sent temporarily at higher than said desired voltage to influence said second control means to disconnect said capacitor means to correct said actual Vars flowing to the desired Vars flowing.

28. Apparatus for keeping track of tap positions of load tapchanging transformers (LTCT), including load tapchanger controls (LTC) for controlling tap-switches and tap-switch motor drive relay means, comprising in combination:

a) first contact means for indicating tap-switch operations, b) second contact means for indicating tapswitch operations in the raise direction, c) third contact means for indicating tapswitch operations in the lower direction, d) at least one fourth contact means settable to indicate selected tap changes, e) means for connecting to said first, second, third and fourth contact means, f) program means for keeping track of tapswitch positions from operations of said first, second and third contacts, and g) program means for keeping records of tap positions.

29. Apparatus as in claim 28 further comprising in combination:

a) means for setting said fourth contact means at tap positions selected as being frequently used in normal operation of the LTCT's, and b) program means for correcting said determination as necessary whenever the tapswitch is on said selected tap position, and keeping a record of tap position whereby said controls correct errors in keeping track of tap positions.

30. Apparatus as in claim 28 further comprising in combination:

a) memory means for storing mathematical models of said transformers with considerations for changes in tap positions, b) program means for determining the Vars flowing in and out of secondaries of said transformers, and c) program means for using tap position knowledge and said mathematical models to determine the Vars flowing in and out of the primary of said transformers.

31. Apparatus as in claim 28 further comprising in combination:

a) program means for determining the change in direction of Vars flowing into said transformer primaries, b) program means for using the directions of Var flow in said transformer primaries as criteria for controlling power system Var flow.

32. Power system control relay apparatus to mitigate effects of voltage collapse comprising in combination:

a) program means for temporarily storing fine grain measurements of AC voltages just prior to a power interruption, b) means for permanently storing said measurements when determined to represent an event of voltage collapse, and c) means for cross correlating fine grain measurements of AC voltages with permanently stored measurements representing known voltage events d) means for distributing said fine grain measurements to experts for determination as to whether said power interruptions were caused by voltage collapse, whereby higher levels of cross correlations are indications of impending voltage collapse interruptions.

33. Apparatus as in claim 32 further comprising in combination:

a) means for measuring further decreases in said AC voltages, and b) means for blocking operations of tapswitches as said AC voltages further decrease thereby avoiding further increase in electric load.

34. Apparatus as in claim 32 further comprising in combination:

a) means for interrupting electric power flow to selected users of said power, b) means for measuring further decreases in said AC voltages, and c) means for initiating said interruption of electric power whereby more power interruptions may be avoided.

35. A method of utilizing many samples of alternating current (AC) voltage signals and AC current signals to directly measure the P and Q components of the flow of AC electric power, the method consisting of the steps of:

a) taking predetermined numbers of digital samples during positive half cycles of AC voltage signals, b) providing tables having double said predetermined number of values of one cycle of a sine wave equally spaced in angle and arranged to be read as a ring starting at any selected point in said ring of values, c) obtaining the fundamental component of said voltage signals by summing products of said samples with values from said ring starting at the point where the values change from negative to positive and ending at the point where the values change from positive to negative, d) taking double said predetermined number of first samples of current signals, e) continuously summing products of said first samples of current signals with values of the sine wave starting at a first point on said ring selected to give the P component of power, f) taking double said predetermined number of second samples of current signals, and g) continuously summing products of said second samples of current signals with values of the sine wave starting at a second point on said ring spaced 90° from said first point to give the Q component of power.

36. A method as in claim 35 further including the steps of:

a) obtaining values for P and Q using a second current, and b) comparing ratios of P and Q for the two currents and determining which current is earlier in phase sequence.

37. A method as in claim 35 further including the step of using the change in value of P from positive to negative as an indication of reversal of power flow.

38. A method of eliminating requirements for communications from first control means regulating the reduction of higher voltages to intermediate voltages to second control means regulating the switching of power factor capacitors, power lines for distributing power at lower voltages, at higher voltages and at intermediate voltages, power being supplied at the lower voltage to multiple user locations, the network including, at the intermediate voltage, said capacitors with said second control means spaced at locations along said intermediate voltage lines, the method comprising the steps of:

a) measuring voltages at said capacitor locations and establishing average voltages from said measured voltages, b) measuring actual voltages in relation to said average voltages, c) varying said capacitor switching times non-linearly faster as voltages deviate away from said average voltages, d) changing said average voltages by the measured amounts of voltage change as said capacitors are switched on and off, e) selectively changing voltage reductions from said higher to said intermediate voltages so as to maintain desired average voltages, and f) selectively further changing said voltage reductions so as to influence capacitor switching times whereby capacitors switch to provide voltages closer to said average voltages.

39. A method as in claim 38 further including the steps of:

a) taking digital samples of positive half waves of AC voltage signals, and b) sampling said signals synchronously with free running analog to digital converters thereby obtaining high resolution of AC voltage differences.

40. A method as in claim 38 further including the steps of:

a) measuring Var flows being supplied at said higher voltages, and b) selectively changing said voltage reductions and influencing capacitor switching times so as to maintain desired Var flows.

41. A method as in claim 38 further including the steps of:

a) selectively placing capacitors using said second control means among lines carrying said intermediate voltages, b) sensing voltage reductions resulting from increasing electrical loads nearby said capacitor locations, and c) timing out and switching capacitors on to the network at locations having the greatest voltage reduction.

42. A method as in claim 38 further including the steps of:

a) selectively placing capacitors using said second control means among lines carrying said intermediate voltages, b) sensing voltage increases resulting from decreasing electrical loads nearby the capacitor locations, and c) timing out and switching capacitors off of the network at locations having the greatest voltage increase.

43. A method as in claim 38 further including the steps of:

a) averaging the voltages at said capacitor locations over time periods of selected numbers of days, and b) raising and lowering intermediate voltages to influence the switching of capacitors as required for changing load variations during each day.

44. A method as in claim 38 including the further steps of:

providing a supervisory control and data acquisition system, b) acquiring generator Var flows, c) acquiring power network Var flows, d) determining desired Var flows into said power network at said intermediate voltages, and e) changing said intermediate voltages thus influencing said second controls to switch capacitors so as to provide said desired Var flows into said power network at said intermediate voltages.

* * * * *